US011511912B2

(12) United States Patent
Sa

(10) Patent No.: US 11,511,912 B2
(45) Date of Patent: Nov. 29, 2022

(54) CONTAINER

(71) Applicant: Jeremy Sa, Richmond (CA)

(72) Inventor: Jeremy Sa, Richmond (CA)

( * ) Notice: Subject to any disclaimer, the term of this patent is extended or adjusted under 35 U.S.C. 154(b) by 39 days.

(21) Appl. No.: 16/860,342

(22) Filed: Apr. 28, 2020

(65) Prior Publication Data

US 2020/0346820 A1 Nov. 5, 2020

(30) Foreign Application Priority Data

Apr. 30, 2019 (CN) ..... 201910361578.2

(51) Int. Cl.

| | |
|---|---|
| ***B65D 25/16*** | (2006.01) |
| ***B65D 25/18*** | (2006.01) |
| ***B65D 81/34*** | (2006.01) |
| ***B65D 25/04*** | (2006.01) |

(52) U.S. Cl.

CPC ..... *B65D 25/16* (2013.01); *B65D 25/04* (2013.01); *B65D 25/18* (2013.01); *B65D 81/3484* (2013.01); *B65D 2255/20* (2013.01)

(58) Field of Classification Search

CPC ..... B65D 81/3869; B65D 81/3484; B65D 25/16; B65D 25/04; B65D 25/18; B65D 2255/20; B65D 21/0219; B65D 21/086

USPC ..... 220/592.2, 8, 495.03

See application file for complete search history.

(56) References Cited

U.S. PATENT DOCUMENTS 8,870,054 B2 * 10/2014 Zhou ..... B65D 77/245 229/101

2011/0248037 A1 * 10/2011 Fung ..... B65D 81/3869 220/592.2

* cited by examiner

*Primary Examiner* — King M Chu

(74) *Attorney, Agent, or Firm* — Cozen O'Connor

(57) ABSTRACT

The present application discloses a container, having a housing with a housing bottom wall and a housing sidewall, and a liner having a liner bottom wall and a liner sidewall. The liner is detachably connected to the housing sidewall, so that the liner is received in the housing chamber. At least a portion between the housing sidewall and the liner sidewall has a gap therebetween. This application discloses a double-layer container having a liner and a housing detachable with each other, so that the housing can use a combination of different shapes of the liner. At the same time, the liner of the container in the present application is made of a flexible material to facilitate cleaning of the liner. On the other hand, the double-layer container of the present application can directly use the liner as a seal, which is convenient for cleaning.

21 Claims, 19 Drawing Sheets

CONTAINER

FIELD OF INVENTION

This application relates generally to containers, and more specifically to double-layer containers.

BACKGROUND OF INVENTION

Double-layer containers are widely used because of their good heat insulation and thermal insulation properties. A double-layer container has an inner layer and an outer container layer, wherein the inner layer is used for containing articles, and the outer container layer is used for housing the inner layer. Compared with single-layer containers, double-layer containers can provide more possibilities for container appearance.

On the other hand, when containers require sealing in multiple uses, for example, lunch boxes, thermal cups, or the like, sealings are generally needed between containers and covers. Such sealings are not only difficult to clean, but also difficult to remove and install.

SUMMARY OF INVENTION

When the inner layer and the outer container layer of a double-layer container can be disassembled from each other, the outer container layer can be matched with one of many inner layers of different shapes, so that the inner layer can have more shapes. When the inner layers are made of various shapes, it can cause difficulties in cleaning the inner layers.

One of the objectives of the present application is to provide a double-layered container whose inner layer and outer container layer can be disassembled, so that the outer container layer can match with an inner layer of one of different shapes. In addition, the inner layers with different shapes are easy to clean. Detailed technical solutions are as follows:

According to a first aspect of the present application, a container is provided and comprises a housing having a housing chamber, the housing forming a housing top opening at a top of the housing, and a liner made of a flexible material. The liner is detachably received in the housing chamber. The liner forms a liner top opening on a top of the liner, wherein the liner has a liner chamber and the liner is liquid proof.

According to the above first aspect, the housing comprises a housing bottom wall surrounding the housing chamber and a housing sidewall, wherein the housing bottom wall is connected to the bottom of the housing sidewall, and the housing chamber forms the housing top opening on a top of the housing sidewall. The liner has a liner bottom wall and a liner sidewall, wherein the liner bottom wall is connected to the bottom of the liner sidewall, and the top of the liner sidewall is detachably connected to the housing sidewall of the housing, so that the liner is detachably received in the housing chamber. The liner top opening is formed at the top of the liner sidewall. At least parts of the housing sidewall and the liner sidewall form a gap therebetween.

According to the above first aspect, the inner contour of the housing sidewall and the outer contour of the liner sidewall are at least partially different.

According to the above first aspect, the flexible material comprises a silicone rubber.

According to the above first aspect, at least part of the housing is made of a transparent material.

According to the above first aspect, the liner bottom wall is supported and connected to the housing bottom wall.

According to the above first aspect, the housing bottom wall has a through hole. The liner bottom wall has a fastening portion. The fastening portion and the through hole are cooperatively connected.

According to the above first aspect, the through hole and the fastening portion are provided with a word and/or a pattern shape.

According to the above first aspect, the housing comprises a mounting boss, which is located between a top and a bottom of the housing. The mounting boss is formed by the housing protruding inwardly. The liner comprises a flange. The flange is formed by an outwardly protruding top of the liner. The flange of the liner abuts against the mounting boss of the housing, so that the top of the liner is detachably connected to the housing.

According to the first aspect, an engaging groove is formed on the top of the mounting boss. The flange has a bent portion, which can be inserted into the engaging groove.

According to the above first aspect, the container further comprises a cover, which is tightly connected to the housing to removably connect the cover to the housing and the liner.

According to the above first aspect, the cover is connected to the top of the housing. The cover is in contact with the top of the liner.

According to the above first aspect, the cover comprises a pressure ring, whose outer diameter is larger than a size of the housing top opening. The pressure ring abuts the top of the housing. The cover also has an end portion connected to the lower end of the pressure ring, wherein the outer diameter of the end portion is smaller than the size of the housing top opening. The end portion extends into the housing chamber to press against the top of the liner.

Another objective of the present application is to provide a sealed container that can be used multiple times, and easily cleaned.

According to a second aspect of the present application, a container is provided and comprises a housing having a housing chamber, the housing forming a housing top opening at the top of the housing. The container also comprises a liner detachably received in the housing chamber. The liner forms a liner top opening at the top of the liner, wherein the liner is formed with a liner chamber, and the liner chamber is liquid proof. The container further comprises a cover, which can be detachably fastened to the housing. The liner is configured to be flexible. The container is so configured that, when the cover is fastened to the housing, the cover is in contact with the top of the liner to seal the liner top opening.

According to the above second aspect, the housing comprises a housing bottom wall and a housing sidewall surrounding the housing chamber, wherein the housing bottom wall is connected to the bottom of the housing sidewall, and the top of the housing sidewall forms the housing top opening. The liner has a liner bottom wall and a liner sidewall, wherein the liner bottom wall is connected to the bottom of the liner sidewall, and the top of the liner sidewall is detachably connected to the housing sidewall of the housing, so that the liner is detachably received in the housing chamber, and the liner top opening is formed at the top of the liner sidewall.

According to the above second aspect, the liner bottom wall is supported and connected to the housing bottom wall.

According to the above second aspect, the housing bottom wall has a through hole. The liner bottom wall has a fastening portion. The fastening portion and the through hole are cooperatively connected.

According to the above second aspect, the housing comprises a mounting boss located between a top and a bottom of the housing sidewall. The mounting boss is formed by the housing sidewall protruding inwardly. The liner comprises a flange, which is formed by an outwardly protruding top of the liner sidewall. The flange of the liner abuts against the mounting boss of the housing, so that the top of the liner sidewall is detachably connected to the housing sidewall of the housing.

According to the above second aspect, the cover comprises at least two locks. The housing comprises at least two corresponding lock holes. The locks each cooperate with the lock holes to detachably snap the cover on the housing.

According to the above second aspect, the liner is made of a flexible material. The flexible material comprises a silicone rubber. The container further comprises a partition plate connected to the liner. The partition plate and the liner are integrally made of a flexible material.

Another objective of the present application is to provide a sealed container that can be used multiple times, and convenient to carry.

According to the above third aspect, a container is provided and comprises a housing having a plurality of telescopic sections forming a telescopically nested connection, and a liner. The liner is enclosed inside the housing. The liner has a liner chamber. The liner is liquid proof.

According to the above third aspect, the liner is capable of being retracted to adjust the height of the liner.

According to the above third aspect, the liner can be extended and retracted through folding.

According to the above third aspect, each of the telescopic sections has a telescopic sidewall. The telescopic sidewall of each of the telescopic sections is movably connected to a telescopic sidewall of an adjacent telescopic section. The housing comprises a housing bottom wall, wherein the plurality of telescopic sections comprise a top telescopic section and a bottom telescopic section. The top of the telescopic sidewall of the top telescopic section forms the housing top opening. The bottom of the telescopic sidewall of the bottom telescopic section is connected to the housing bottom wall.

According to the above third aspect, the plurality of telescopic sections comprise a first telescopic section and a second telescopic section disposed adjacently to each other. The first telescopic section has a first telescopic sidewall. The second telescopic section has a second telescopic sidewall. The diameter of the first telescopic section is larger than the diameter of the second telescopic section. The container comprises a locking device. The locking device comprises a locking portion and a locking receiving portion that cooperate with each other. The locking portion is formed on one of the first telescopic sidewall and the second telescopic sidewall. The lock receiving portion is formed on a corresponding position on the other of the first telescopic sidewall and the second telescopic sidewall. The locking device can lock or release the first telescopic section or the second telescopic section. The locking device is so configured that, when the locking device locks the first telescopic section or the second telescopic section, the first telescopic section and the second telescopic section cannot move relative to each other; and when the locking device releases the first telescopic section or the second telescopic section, the first telescopic section and the second telescopic section can move relatively to each other, so that the second telescopic section is retracted into the first telescopic section or extends out from the first telescopic section.

According to the above third aspect, the lock portion comprises a projection. The lock receiving portion is formed with a lock hole, wherein the projection can be inserted into or withdrawn from the lock hole. The lock portion and the lock reception portion are so configured that, when the projection is inserted into the locking hole, the locking hole can lock the projection; when the projection exits the locking hole, the locking hole can release the projection. The locking device further comprises a locking pin that drives the projection to insert into or exit from the locking hole.

According to the above third aspect, the container further comprises a sliding mechanism. The sliding mechanism is formed at a corresponding portion on the first telescopic sidewall and the second telescopic sidewall. The sliding mechanism can guide the first telescopic section and the second telescopic section to slide relative to each other in a sliding direction.

According to the third aspect, the sliding mechanism has a guide groove and a slider slidable relative to each other. The guide groove is formed on one of the first telescopic sidewall and the second telescopic sidewall. The slider is formed on the other of the first telescopic sidewall and the second telescopic sidewall. The guide groove extends in the sliding direction. The slider and the guide groove can move relatively to each other in the sliding direction.

According to the above third aspect, the locking device comprises a locking groove extending away from the sliding direction, wherein the slider can enter into or exit from the locking groove. The locking groove is so configured that, when the slider enters into the locking groove, the locking groove can lock the slider; when the slider exits from the locking groove, the locking groove can release the slider.

According to the above third aspect, the locking groove comprises a top locking groove and a bottom locking groove. The top locking groove is connected to the top of the guide groove. The bottom locking groove is connected to the bottom of the guide groove.

According to the above third aspect, the locking device is formed with a card slot inside the guide groove. The size of the card slot matches the size of the slider, so that the card slot can accommodate the slider. The card slot is so configured that, when the slider enters the card slot, the card slot accommodates and locks the slider; when the slider exits the card slot, the card slot releases the slider.

According to the third aspect, the card slot comprises a top card slot and a bottom card slot. The top card slot is connected to the top of the guide groove. The bottom card slot is connected to the bottom of the guide groove.

According to the above third aspect, the liner comprises a liner sidewall and a liner bottom wall enclosing a liner chamber. The liner bottom wall is connected to the bottom of the liner sidewall. The top of the liner sidewall is detachably connected to the telescopic sidewall of the top telescopic section of the housing, so that the liner is detachably disposed in the housing. The top of the liner sidewall forms a liner top opening. At least parts of the telescoping sidewall and the liner sidewall form a gap. The liner sidewall has a pleated shape, so that the liner sidewall can fold when the plurality of telescopic sections of the housing telescopically retract.

According to the above third aspect, the liner is made of a flexible material. The housing is made of a rigid material.

According to the above third aspect, the liner bottom wall is supported and connected to the housing bottom wall.

According to the above third aspect, the housing comprises a mounting boss. The mounting boss is formed on the telescopic sidewall of the top telescopic section. The telescopic sidewall of the top telescopic section protrudes inwardly to form the mounting boss. The liner comprises a flange, which is formed by an outwardly protruding top of the liner sidewall. The flange of the liner abuts against the mounting boss of the housing, so that the top of the liner sidewall is detachably connected to the housing.

According to the above third aspect, the container further comprises a cover, which is fastened to the top of the telescopic sidewall of the top telescopic section to detachably connect the cover to the housing and the liner.

According to the above third aspect, a heating device or a sensing device is provided in a gap between the telescopic sidewall and the liner sidewall.

This application provides a double-layer container, which comprises a liner and a housing detachable from each other, so that the housing can be combined with different shaped liners. At the same time, the liner in the present application is made of a flexible material to facilitate cleaning of the liner. On the other hand, in the double-layer container of the present application, the liner can be directly used as a sealing member for the container to allow convenient cleaning of the sealing member. The double-layer container of the present application comprises a retractable housing. By proving a liquid proof liner, the housing no longer needs to be liquid proof and can be formed as a reliable retractable structure.

BRIEF DESCRIPTION OF THE DRAWINGS

The following description is set forth in connection with the attached drawing figures, which are not necessarily to scale, emphasis instead generally being placed upon illustrating the principles of the invention. In the drawing figures.

DETAILED DESCRIPTION OF EMBODIMENTS

Figure 1:
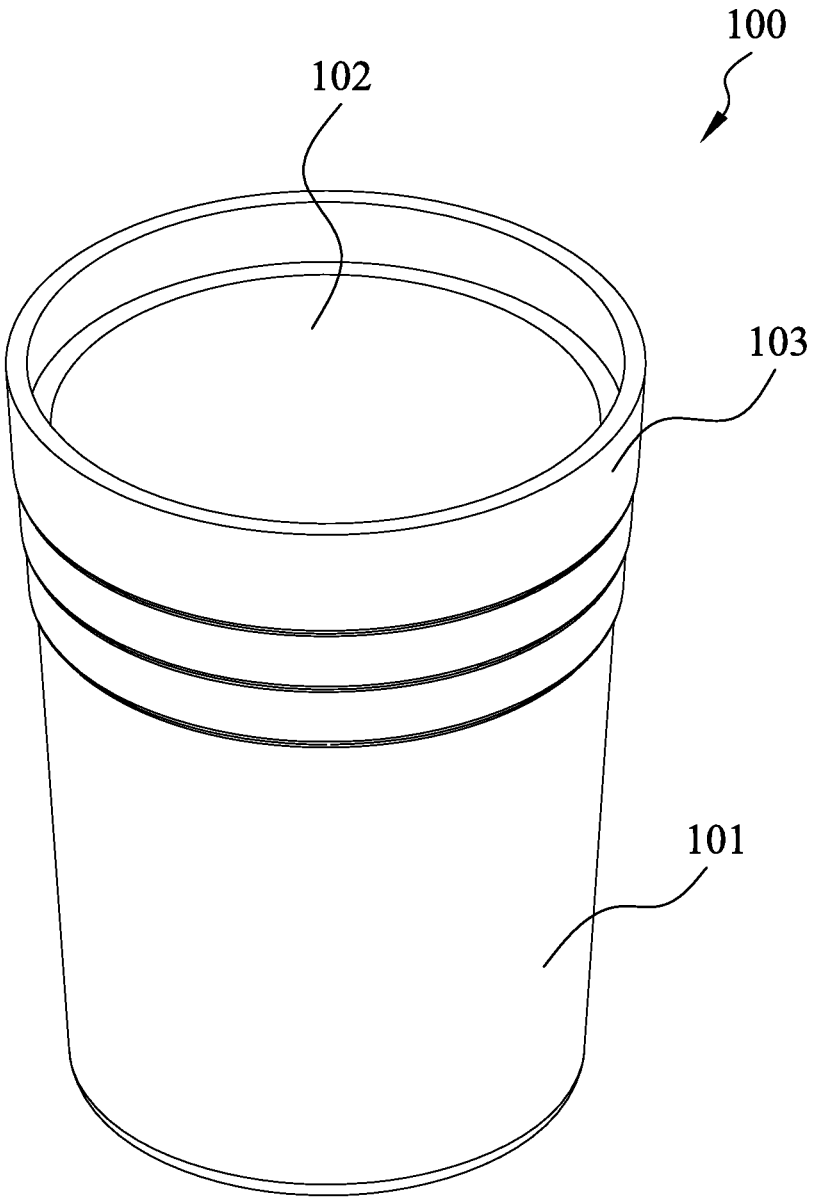
FIG. 1 is a perspective view of a container 100 according to an embodiment of the present application.

Various specific embodiments of the present application will be described below with reference to the accompanying drawings, which form a part of this specification. It should be understood that although terminology is used in this application, such as "front", "rear", "up", "down", "left", "right", "top", "bottom", "inside", "outside", etc., to describe the orientation of various example structural parts and elements of this application, such terminologies are used here for the convenience of explanation only and are determined based on the exemplary orientation shown in the drawings. Since the embodiments disclosed in this application can be set in different directions, these terminologies indicating directions are only for illustration and should not be considered as limitations. Wherever possible, the same or similar reference numbers used in the present application refer to the same parts.

FIG. 1 is a perspective view of a container 100 according to an embodiment of the present application, to illustrate the overall structure of the container 100. As shown in FIG. 1, the container 100 is in the shape of a cup. The container 100 comprises a housing 101, a liner 102, and a cover 103. The liner 102 is positioned inside the housing 101. The cover 103 is connected to the top of the housing 101 and the liner 102. The cover 103 has a shape that fits both upper portions of the housing 101 and the liner 102, so as to fix the relative position of the housing 101 and the liner 102 on one hand and be used as a cup opening on the other hand. In the embodiment shown in the drawing figures, the container 100 is an open cup. The contents in the liner 102 can be taken out or poured out through the cover 103. When a user drinks water from the container 100, the user's lips can be in contact with the cover 103. In one example, the cover 103 can be made of plastic or metal materials, so as not to affect the user's experience when contacting the cover 103.

Figure 2A:
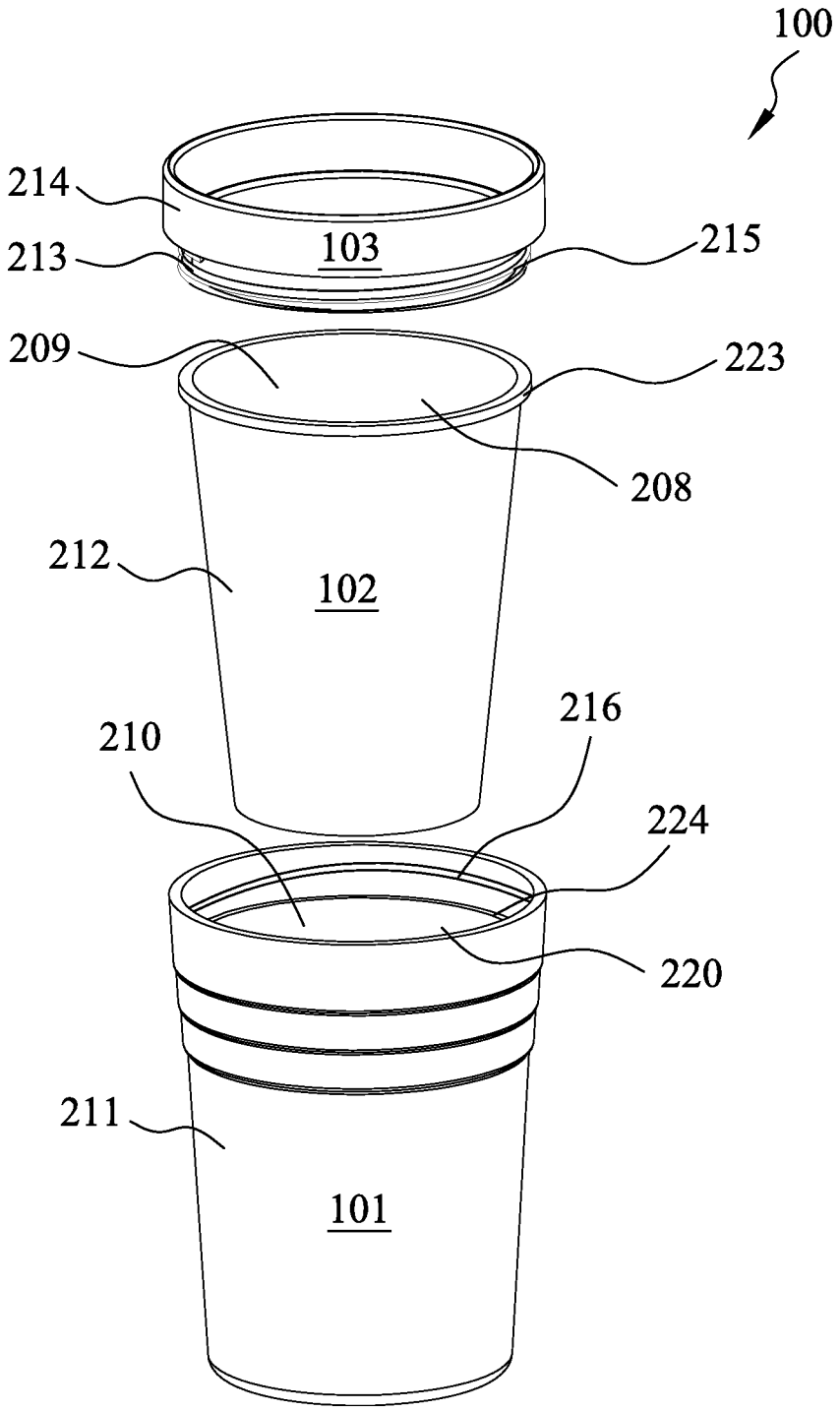
FIGS. 2A and 2B are exploded perspective views from two different angles showing the container 100 in FIG. 1.
Figure 2B:
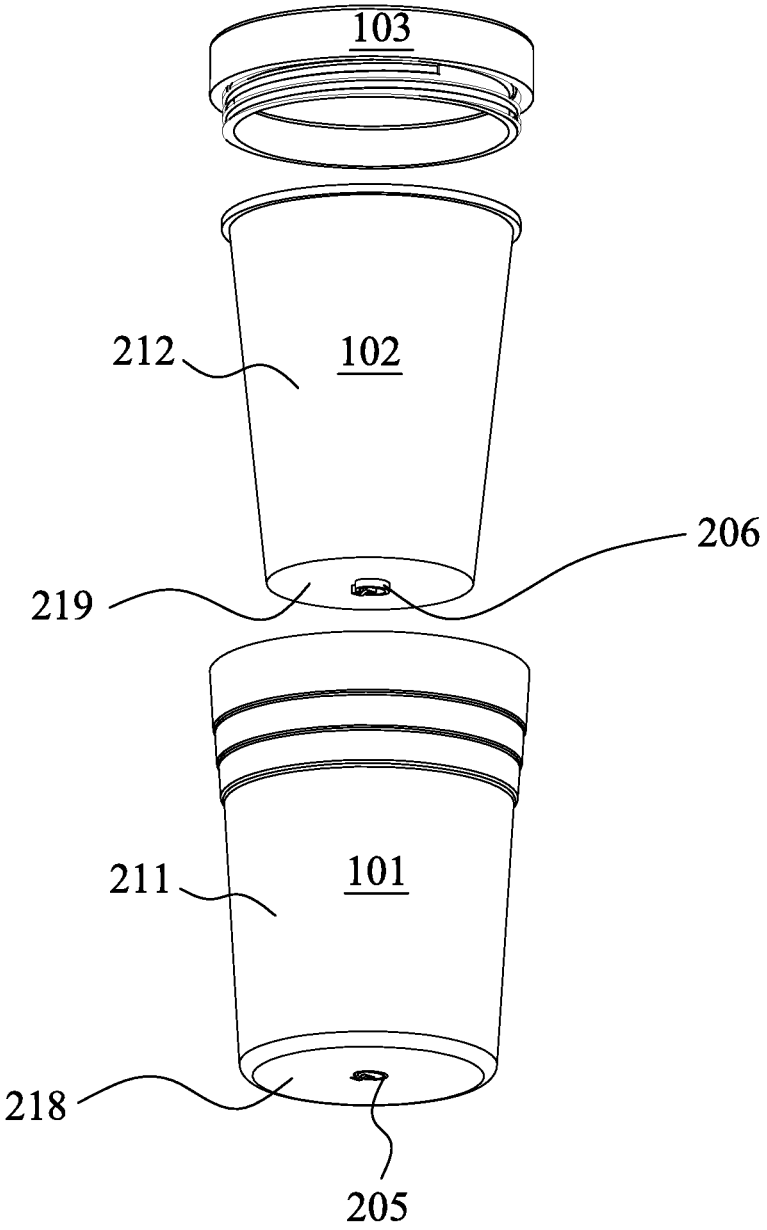

FIGS. 2A and 2B are exploded perspective views from two angles showing the container 100 in FIG. 1, wherein FIG. 2A is taken from an angle viewed from top down and FIG. 2B is taken from an angle viewed from below up, to illustrate the various components of the container 100. The specific cooperation relationship of the various components will be described in detail with reference to FIG. 3.

As shown in FIGS. 2A and 2B, the housing 101 is cylindrical and comprises a housing sidewall 211 and a housing bottom wall 218, wherein the housing bottom wall 218 is connected at the bottom edge of the housing sidewall 211. The housing sidewall 211 surrounds the housing bottom wall 218 and forms a housing chamber 210. The housing chamber 210 defines a housing top opening 220 at the top edge portion of the housing sidewall 211. The liner 102 can be assembled into the housing chamber 210 or taken out from the housing chamber 210 through the housing top opening 220. A mounting boss 224 is formed on an inner surface of the housing sidewall 211 between its top edge and bottom edge and extends in a circumferential direction to form a circular shape. Spiral tooth 216 are formed on the inner surface of the housing sidewall 211 between the top edge of the housing sidewall 211 and the mounting boss 224.

In one example, the mounting boss 224 is formed by the housing sidewall 211 protruding inwardly. The housing bottom wall 218 is formed with a through hole 205 passing through the housing bottom wall 218.

The liner 102 is also cylindrical and comprises a liner sidewall 212 and a liner bottom wall 219. The liner bottom wall 219 is connected to the bottom edge portion of the liner sidewall 212. The liner sidewall 212 also surround the liner bottom wall 219 to form a liner chamber 209. The liner chamber 209 forms a liner top opening 208 at the top edge of the liner sidewall 212. Through the liner top opening 208, contents (solid or liquid content) can be added in the liner chamber 209 or removed from the liner chamber 209. A circle of flange 223 is formed at the top edge portion of the liner sidewall 212 and extends in a circumferential direction. In an example, the flange 223 is formed by protruding the top edge of the liner sidewall 212 outwardly. A buckling portion 206 is formed on the bottom surface of the liner bottom wall 219 and protrudes outwardly. The liner chamber 209 is a liquid proof. In the present embodiment, the liquid proof means that even if the content inside the liner chamber 209 is liquid, the content will not leak out from any other parts of the liner 102 (such as the liner sidewall 212, the liner bottom wall 219 and their connection portions) except for the liner top opening 208, so that the liner 102 can reliably receive or carry the contents.

It should be noted that, in some embodiments, the liner can be formed without a liner bottom wall. The liner chamber is directly formed by the liner sidewall, as long as the liner chamber 209 can be liquid proof. Similarly, the housing can be formed without a housing bottom wall.

The cover 103 comprises an annular end portion 213 and an annular pressure ring 214. The end portion 213 is connected to the lower end of the pressure ring 214. The outer diameter of the end portion 213 is smaller than the outer diameter of the pressure ring 214, so that the cover 103 forms a step 283 at the connection portion between the end portion 213 and the pressure ring 214. A spiral tooth 21 is formed on the outer surface of the end portion 213. The spiral tooth 215 is capable of engaging with a spiral tooth 216 formed on the housing sidewall 211, so as to detachably fasten the end portion 213 to the housing sidewall 211. When the end portion 213 is tightly fastened to the housing sidewall 211, the lower surface of the end portion 213 presses against the flange 223 on the liner sidewall 212, while the step 283 abuts the top edge of the housing sidewall 211, to connect the cover 103 to the housing 101 and the liner 102.

Figure 3:
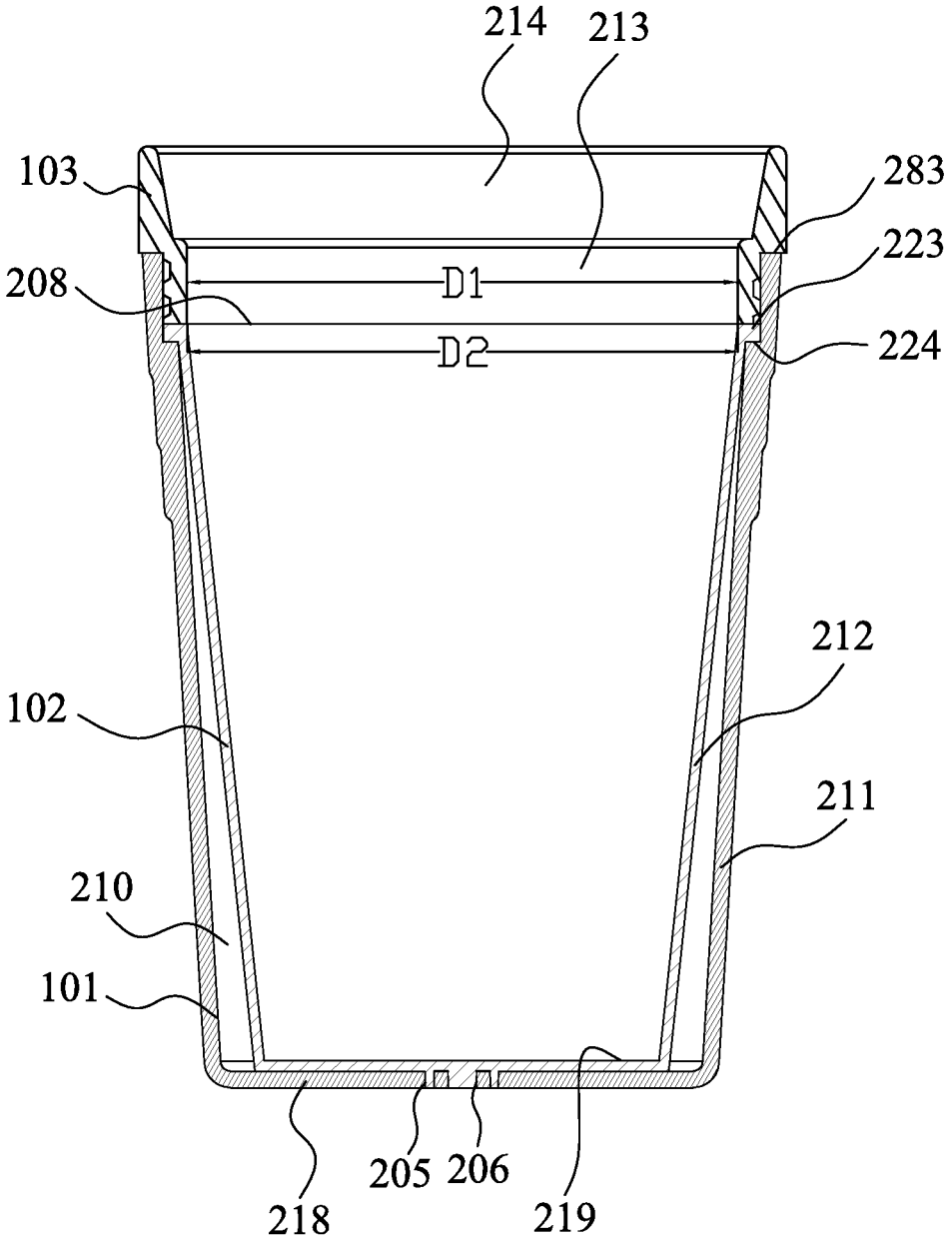
FIG. 3 is an axial sectional view of the container 100 shown in FIG. 1.

FIG. 3 is an axial cross-sectional view of the container 100 shown in FIG. 1, to illustrate the cooperation structure between the housing 101, the liner 102, and the cover 103.

As FIG. 3 shows, when the housing 101, the liner 102, and the cover 103 are assembled, the liner 102 is detachably connected inside the housing 101. The cover 103 connects with the housing sidewall 211 through the spiral tooth 215 and the spiral tooth 216 and presses against the flange 223 formed at the top edge of the housing sidewall 211 and the top edge of the liner sidewall 212, whereby the housing 101, the liner 102, and the cover 103 can be detachably assembled together.

More specifically, the flange 223 at the top edge of the liner sidewall 212 of the liner 102 abuts against the mounting boss 224 on the housing sidewall 211 of the housing 101. The fastening portion 206 on the liner bottom wall 219 of the liner 102 is fastened into the through hole 205 in the housing bottom wall 218 of the housing 101, so that the liner 102 is detachably connected inside the housing 101. Incidentally, the top edge of the liner sidewall 212 of the liner 102 can also be formed as other connection structures, while the housing sidewall 211 is formed with other corresponding mating structures, so long as the top edge of the liner sidewall 212 can be detachably connected with the housing sidewall 211, such as the embodiment shown in FIG. 5. Similarly, the liner bottom wall 219 and the housing bottom wall 218 can be connected together by other mating structures, as long as it ensures that the liner bottom wall 219 is supported on the housing bottom wall 218. In an example, the through hole 205 and the fastening portion 206 are formed in the shape of a word and/or a pattern, such as a trademark logo shape. In another example, the through hole 205 and the fastening portion 206 are asymmetrical to prevent the liner 102 from rotating relative to the housing 101.

The end portion 213 of the cover 103 passes through the housing top opening 220 and enters into the housing chamber 210. The end portion 213 contacts and presses against the flange 223 on the liner sidewall 212 inside the housing chamber 210 from an upper side, while the step 283 of the pressure ring 214 abuts the top edge of the housing sidewall 211 from an upper side. In an example, the inner diameter D1 of the end portion 213 is the same as the dimension D2 of the liner top opening 208, so that the contents in the liner 102 can smoothly flow out from the inner surface of the end portion 213 of the cover 103. When the cover 103 and the housing sidewall 211 are connected by the spiral teeth 215 and 216, the cover 103 can be detachably connected to the housing 101 and the liner 102, so that the housing 101 and the liner 102 can be detachable connected by the cover 103. Of course, it should be noted that the cover 103 and the housing sidewall 211 can also be fastened and connected in various other ways, as long as it ensures that the cover 103 and the housing sidewall 211 are detachably connected. In an alternative embodiment, the liner 102 and the housing 101 can be directly connected to each other without using the cover 103.

Thus, by providing the cover 103 and corresponding connecting structures, the liner 102 can be mounted inside the housing 101 and be removed from the housing 101.

And thus, except for the top edge of the liner sidewall 212, other portions of the liner sidewall 212 of the liner 102 need no additional structure to engage the housing sidewall 211 and enable detachable connection with the housing 101; therefore, the liner sidewall 212 can be designed as any desired shape. In one example, the housing sidewall 211 and liner sidewall 212 can have shapes that are not entirely the same or matching, so that the inner contour of the housing sidewall 211 and the outer contour of the liner sidewall 212 are at least partially different, to form a gap in at least a portion of the area between the housing sidewall 211 and the liner sidewall 212. In the embodiment shown in the present application, the housing sidewall 211 is made of a transparent material, so that the liner sidewall 212 designed with different shapes can be seen through the housing sidewall 211.

In one example, the liner 102 is made of a flexible material. In some embodiments, the liner is integrally formed of a flexible material, such as silicone rubber, to more easily form the liner sidewall 212 of the liner 102 into any designed shape, such as cartoon characters, 12 Chinese zodiac signs, 12 constellation signs, landmarks of tourism products, numbers, words, etc., and print patterns or photos on the outer surface of the liner 102 and color them. One can combine a housing 101 with different liners 102, to distinguish between different users of the containers through different liners 102. In some special cases, different liners 102 can also be used to distinguish different contents contained in the liners 102.

If the liner 102 is made of a rigid material, when the liner sidewall 212 is designed in various shapes, the corners or gaps of the liner 102 can be difficult to clean and accumulate bacteria. Even if the liner 102 can be detached from the housing 101, a human hand cannot fully reach into the liner 102, due to the depth of the liner 102 when the liner sidewall 212 is in certain special shape. Consequently, it would not be easy to completely clean the liner 102. Forming a liner 102 of a flexible material can overcome the above problems. When the liner 102 of a flexible material is detached from the housing 101, the liner 102 can be turned inside out to expose the inner surface of the liner 102, so as to completely clean the liner 102. Therefore, the liner 102 of the container 100 of the present application can not only be used in combination with the housing 101 to change the liner 102 to a different shape, but also be convenient to clean.

Further, since the top edge of the liner sidewall 212 is located below the top edge of the housing sidewall 211, the liner 102 can be located entirely inside the housing chamber 210. The liner 102 made of a flexible material can also ensure the sealing between the cover 103 and housing 101, to prevent contents stored in the liner 102 from leaking into the gap between the housing 101 and the liner 102.

When the liner 102 is placed into the housing 101 or removed from the housing 101, the pressure in the housing chamber 210 will change, which can cause the liner 102 of a flexible material to deform or other problems. By providing a through hole 205 on the housing bottom wall 218, the housing chamber 210 can communicate with outside environment. A space of at least a certain size is provided between the liner sidewall 212 and the housing sidewall 211, to reduce the change in air pressure between the liner sidewall 212 and the housing sidewall 211.

More specifically, when the liner 102 of a flexible material is assembled, the liner 102 is first placed into the housing 101. The cover 103 is then connected with the housing sidewall 211. When the liner 102 passes through the housing top opening 220 and enters into the housing chamber 210 of the housing 101 from top down, air inside the housing chamber 210 can be discharged via the through hole 205 in the housing bottom wall 218, so that the liner 102 can be inserted into the housing chamber 210. When the flange 223 on the liner sidewall 212 abuts against the mounting boss 224 on the housing sidewall 211, and the fastening portion 206 engages in the through hole 205, the liner 102 is in place inside the housing 101. By connecting the cover 103 and the housing sidewall 211, the liner 102 is secured in the housing 101.

To remove the liner 102 of a flexible material, the cover 103 is first detached from the housing sidewall 211 from the top, before the liner 102 is taken out from the housing 101. When the liner 102 is being lifted up and out from the housing chamber 210 of the housing 101, the fastening portion 206 is separated from the through hole 205 to allow external air to pass through the through hole 205 and flow into the housing chamber 210, to facilitate the removal of the liner 102 from the housing 101. And since at least part of the area between the liner sidewall 212 and the housing sidewall 211 forms a certain space, frictional resistance that prevents the relative movements between the liner sidewall 212 and the housing sidewall 211 can be reduced, which can also facilitate the removal of the liner 102 from the housing 101.

In other embodiment, the container 100 can further comprise an upper lid (not shown) that is detachably fastened on top of the cover 103. According to the application needs of the container 100, the upper lid can be formed in the shape of a cup cover or a pacifier.

Figure 4:
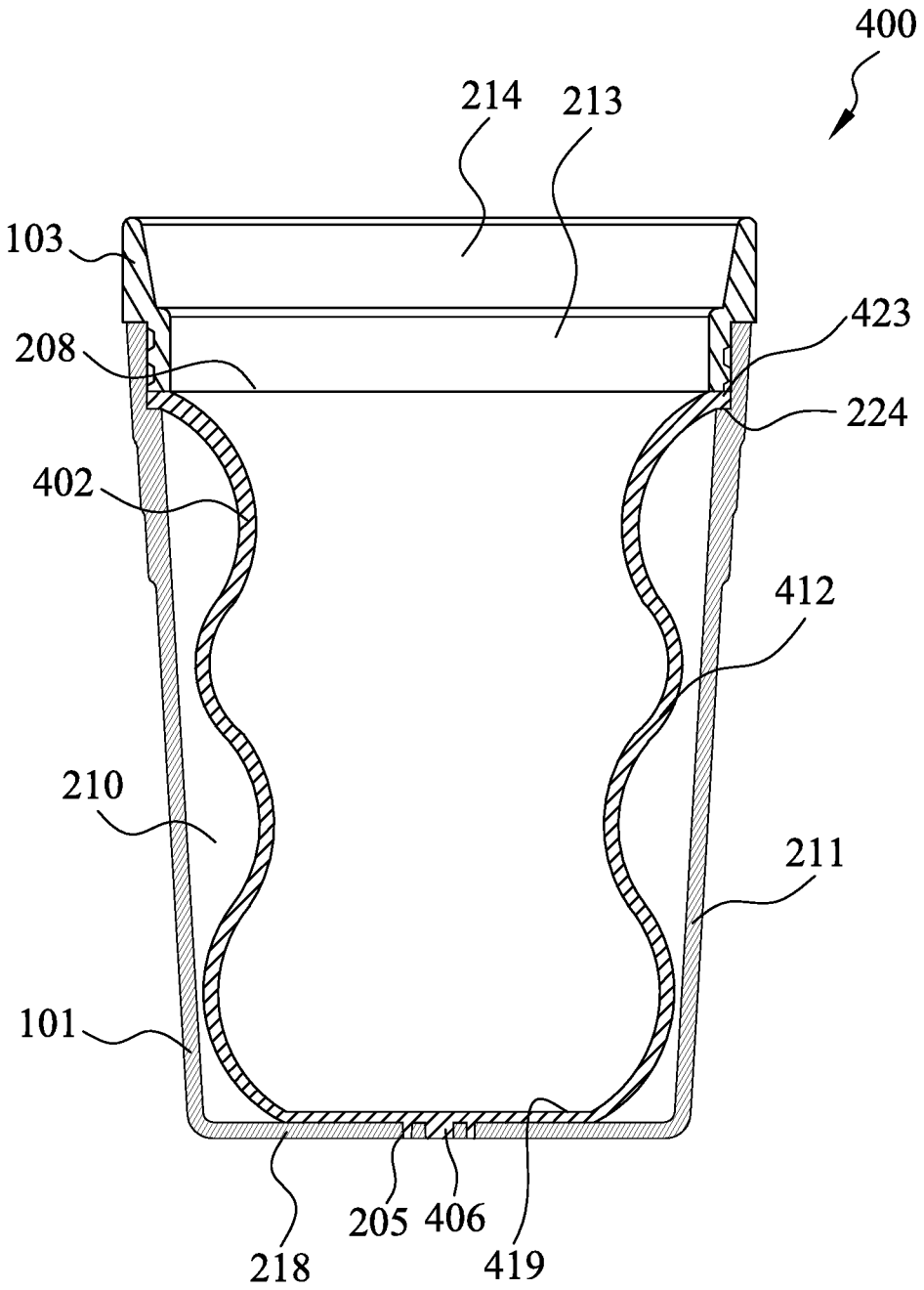
FIG. 4 is an axial cross-sectional view of a container according to another embodiment of the present application.

FIG. 4 is an axial cross-sectional view of a container 400 of yet another embodiment of the present application, showing different shapes of the liner sidewall 212. As FIG. 4 shows, the container 400 comprises a housing 101, a liner 402, and a cover 103, wherein the housing 101 and the cover 103 have the same structures as the housing 101 and the cover 103 of the container 100 shown in FIG. 1 to FIG. 3 and thus redundant description is omitted.

The liner 402 comprises a liner sidewall 412 and a liner bottom wall 419, wherein the liner bottom wall 419 is connected to a bottom edge portion of the liner sidewall 412. The liner bottom wall 419 is formed with a fastening portion 406, which is fastened to the through hole 205 on the housing bottom wall 218. The top edge of the liner sidewall 412 forms a flange 423, which abuts against the mounting boss 224 on the housing 101. The outer contour between the top edge and the bottom edge of the liner sidewall 412 forms a wavy shape. Such outer contour of the liner sidewall 412 and the housing sidewall 211 form an uneven gap therebetween. The end portion of the cover 103 is tightly connected to the housing sidewall 211, so that the pressure ring 214 of the cover 103 abuts the top edge of the housing sidewall 211 and the end portion 213 of the cover 103 presses against the flange 423. Thus, the top edge of the liner sidewall 412 is detachably connected to the housing sidewall 211 of the housing 101, so that the liner 402 is received in the housing chamber 210 and detachably connected to the housing 101.

With reference to FIG. 4, it can be seen that the liner can be detachably connected to the housing, as long as the top edge of the liner sidewall and the liner bottom wall are formed to match with the housing. Thus, the outer contour between the top and bottom edges of the liner sidewall can be designed to have any desired shapes. For different liners, the structures of the housing and the cover need not be changed.

Figure 5:
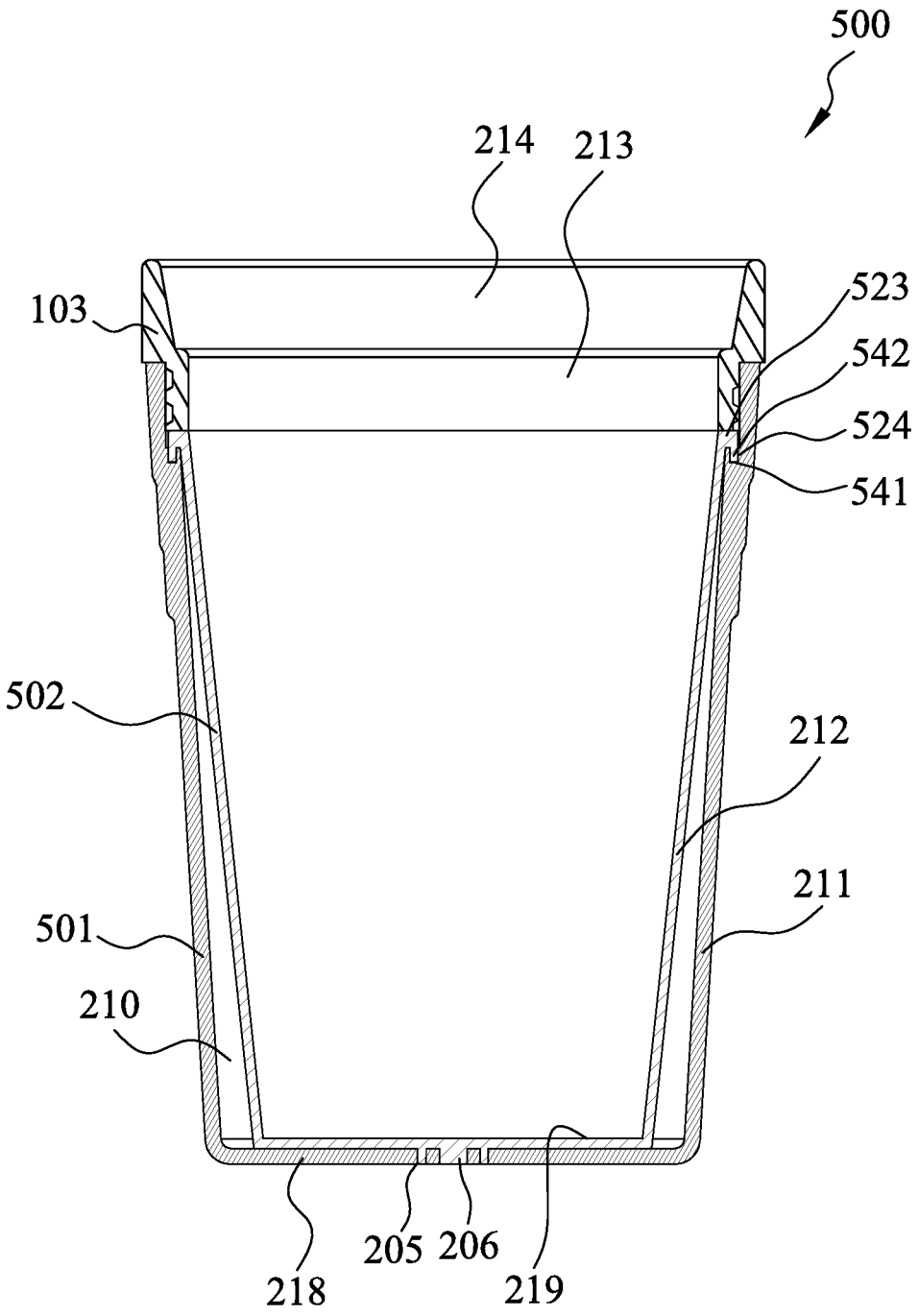
FIG. 5 is an axial cross-sectional view of a container according to another embodiment of the present application.

FIG. 5 is an axial cross-sectional view of a container 500 according to another embodiment of the present application, to illustrate different detachable connection structures between the top edge of the liner sidewall and the housing sidewall. As FIG. 5 shows, the container 500 comprises a housing 501, a liner 502, and a cover 103, wherein the cover 103 is the same as the cover 103 of the container 100 shown in FIG. 1 to FIG. 3 and thus redundant description is omitted.

The housing 501 and the liner 502 are configured similarly to the housing 101 and the liner 102 of the container 100 shown in FIG. 1 to FIG. 3, except that the mounting boss 524 on the housing sidewall 211 is formed with a circular engaging groove 541. The engaging groove 541 is recessed downwardly from the top surface of the mounting boss 524. The end of the flange 523 of the liner sidewall 212 is formed with a downwardly extending bent portion 542. When the bent portion 542 is inserted in the engaging groove 541, the top edge of the liner sidewall 212 is detachably connected to the housing sidewall 211. The cover 103 and the housing sidewall 211 are tightly joined, so that the cover 103 is detachably connected to the housing 501 and the liner 502, i.e., the bent portion 542 is held in the engagement groove 541.

In this application, other detachable connection structures can also be used to connect the top edge of the liner sidewall and the housing sidewall, as long as the connection portion is arranged at the top edge of the liner sidewall. Therefore, different liners can be detachably connected to the housing, so long as the liner sidewalls have the same top edge and the same liner bottom. The outer profile of the liner sidewall between the top edge and the bottom edge can be designed into any desired shapes.

Figure 6:
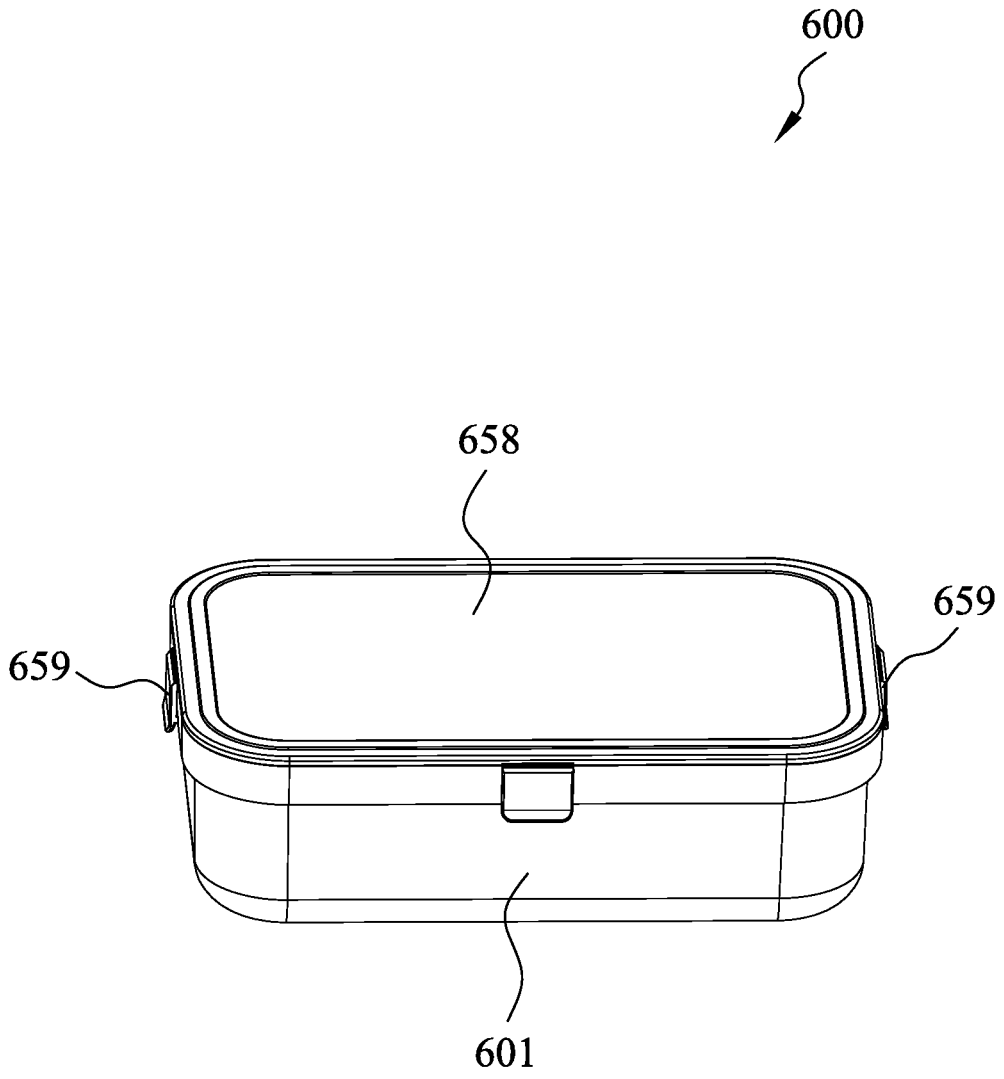
FIG. 6 is a perspective view of a container 600 according to another embodiment of the present application.

FIG. 6 is a perspective view of a container 600 according to another embodiment of the present application. As is shown in FIG. 6, the container 600 has a rectangular box shape. The container 600 comprises a housing 601 and a cover 658. Both sides of the cover 658 are formed with latches 659. Through the latch 659, the cover 658 can detachably engage the housing 601.

Figure 7A:
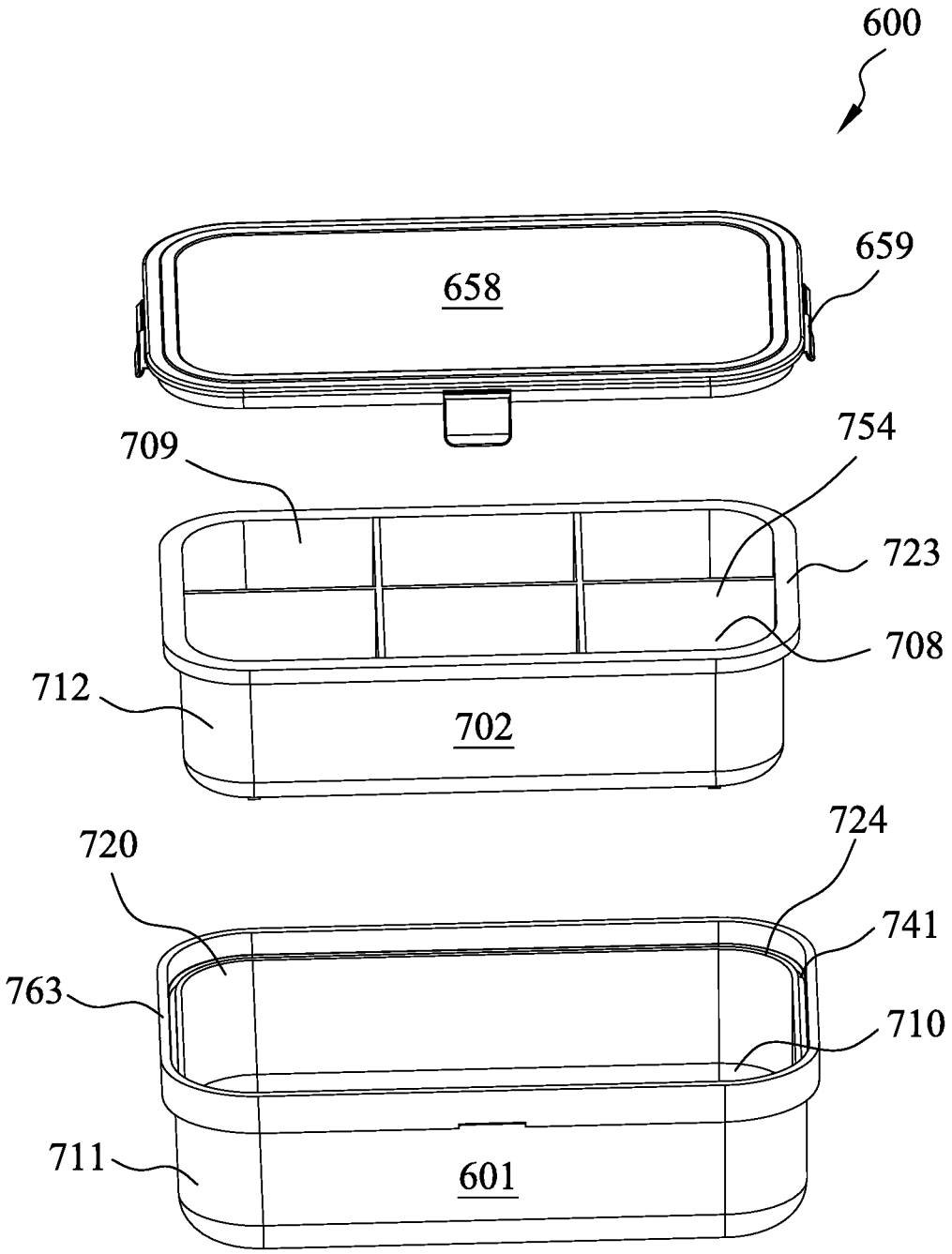
FIGS. 7A and 7B are exploded perspective views from two different angles showing the container 600 in FIG. 6.
Figure 7B:
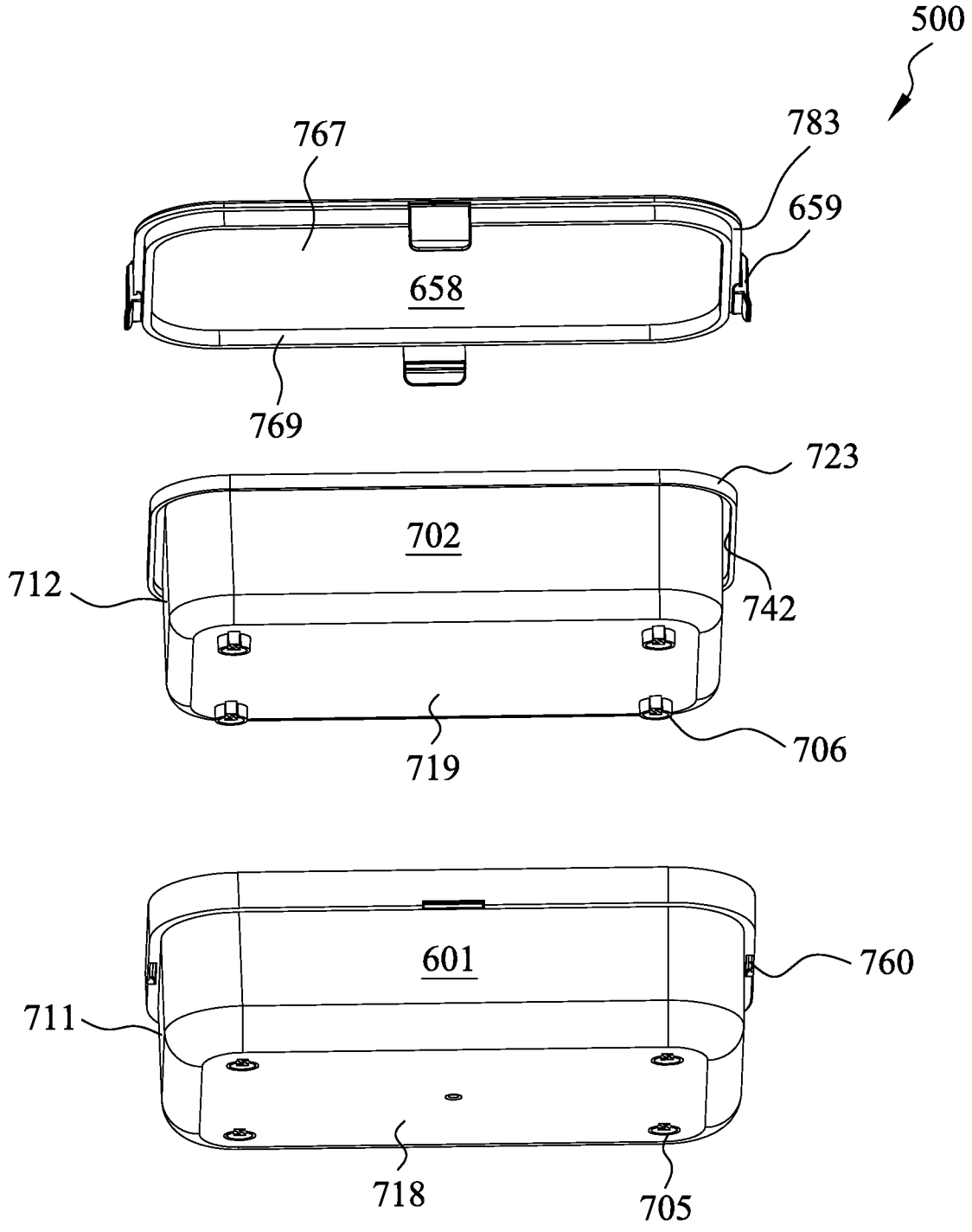

FIGS. 7A and 7B are exploded perspective views from two different angles showing the container 600, for illustrating the internal structure of the container 600, wherein FIG. 7A is taken from a top down angle, and FIG. 7B is taken from a bottom up angle.

As FIGS. 7A and 7B show, the container 600 further comprises a liner 702. The liner 702 has a shape substantially the same as the housing 601 and is accommodated in the housing 601. The housing 601 is a rectangular box body and comprises a housing sidewall 711 and a housing bottom wall 718, wherein the housing bottom wall 718 is connected to the bottom edge portion of the housing sidewall 711. The housing sidewall 711 surrounds the housing bottom wall 718 to form a housing chamber 710. The housing chamber 710 forms a housing top opening 720 at the top edge of the housing sidewall 711. Through the housing top opening 720, the liner 702 can be fitted into the housing chamber 710 or removed from the housing chamber 710. A mounting boss 724 is formed on the inner surface of the housing sidewall 711 between its top edge and its bottom edge and extends in a circumferential direction as a circle. The mounting boss 724 is formed with a circular engaging groove 741. The engaging groove 741 is recessed downwardly from the top surface of the mounting boss 724. In an example, the mounting boss 724 is formed by the inner surface of the housing sidewall 211 protruding inwardly. The outer surface of the top edge of the housing sidewall 711 is formed with a plurality of locking holes 760 which cooperate with the locking buckles 659. The housing bottom wall 718 is formed with a plurality of through holes 705 passing through the housing bottom wall 718. For example, four through holes 705 are formed.

The liner 702 is also a rectangular box body. The liner 702 has flexibility, for example, formed of a flexible material. For example, the liner 702 is integrally formed of a flexible material. The liner 702 comprises a liner sidewall 712 and a liner bottom wall 719. The liner bottom wall 719 is connected to the bottom edge of the liner sidewall 712. The liner sidewall 712 also surrounds the liner bottom wall 719 to form a liner chamber 709. The liner chamber 709 defines a liner top opening 708 at the top edge portion of the liner sidewall 212. Through the liner top opening 708, contents (solid or liquid contents) can be added in the liner chamber 709 or removed from the liner chamber 709. The liner chamber 709 is liquid proof. In this embodiment, liquid proof means that even if the content in the liner chamber 709 is liquid, the content will not leak through any parts of the liner 702 (such as the liner sidewall 712, the liner bottom wall 719, and their joints) other than the liner top opening 708, so that the liner 702 can reliably contain or carry the contents.

Alternatively, the liner 702 further comprises a partitioning plate 754. The partition plate 754 is capable of dividing the liner chamber 709 into a number of smaller portions, so that contents can be stored in different portions insider the liner chamber 709. In an example, the partition plate 754 and the liner 702 are integrally made of a flexible material. A circular flange 723 is formed on the top edge of the liner sidewall 712 and extends in a circumferential direction. In an example, the flange 723 is formed by an outwardly protruding top edge of the liner sidewall 712. A bent portion 742 is formed on the end of the flange 723 and extends downwardly. The bottom surface of the liner bottom wall 719 is formed with a plurality of outwardly protruding engaging portions 706 that cooperate with the through holes 705. For example, four engaging portions 706 are provided.

Similarly, in some embodiments, the liner can be formed without a liner bottom wall. The liner chamber can be directly formed by the liner sidewall, as long as the liner chamber can be liquid proof. The housing can also be formed without a housing bottom wall.

The cover 658 comprises a rectangular cover surface 767 and a rectangular ring-shaped end portion 769. The end portion 769 is connected to the lower end of the cover surface 767. The outer diameter of the end portion 769 is smaller than the outer diameter of the cover surface 767, so that the cover 658 forms a step 783 at the connection portion between the end portion 769 and the cover surface 767. The four sides of the surface cover 767 are each formed with a latch 659. The latches 659 are capable of locking into the latch slots 760 on the housing sidewall 711 to detachably snap fasten the cover 658 with the housing sidewall 711.

Figure 8:
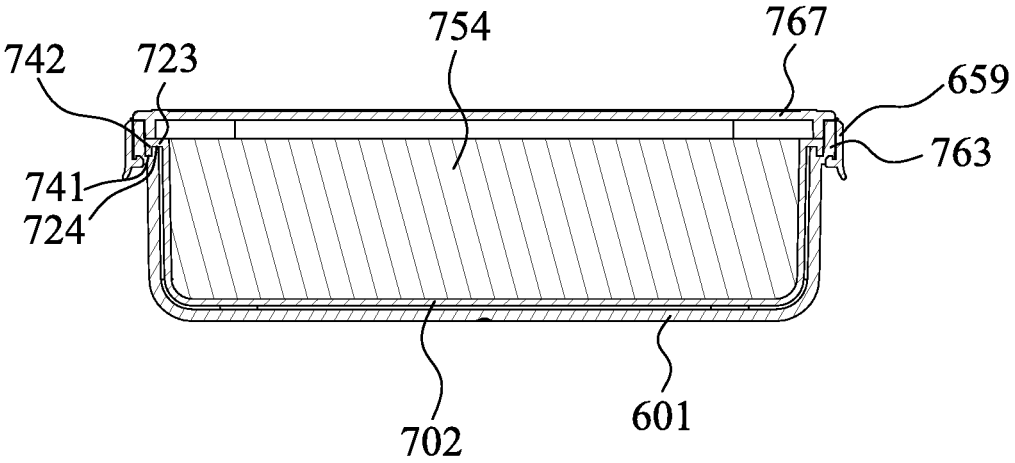
FIG. 8 is an axial cross-sectional view of the container 600 shown in FIG. 6.

FIG. 8 is an axial cross-sectional view of the container 600 shown in FIG. 6 for illustrating the fitting structures between a housing 601, a liner 702, and a cover 658. As FIG. 8 shows, when the housing 601, the liner 702, and the cover 658 are assembled, the liner 702 is detachably connected inside the housing 601. The cover 658 is connected to the housing sidewall 711 through latching structures comprising the latch 659 and the latch slot 760 and presses against the top edge of the housing sidewall 711 and the flange 723 at the top edge of the liner sidewall 712. As a result, the housing 601, the liner 702, and the cover 658 can be detachably assembled together.

More specifically, the flange 723 at the top edge portion of the liner sidewall 712 of the liner 702 is brought into contact with the mounting boss 724 on the housing sidewall 711 of the housing 601. The bent portion 742 on the flange 723 is inserted into the engaging groove 741 on the mounting boss 724, so that the top edge of the liner sidewall 712 is detachably connected to the housing sidewall 711. The fastening part 706 on the liner bottom wall 719 of the liner 702 is fastened to the through hole 705 in the housing bottom wall 718 of the housing 601, so that the liner bottom wall 719 of the liner 702 is supported on and connected to the housing bottom wall 718 of the housing 601.

The end 769 of the cover 658 is inserted into the housing chamber 710 through the housing top opening 720, and contacts and presses the flange 723 on the liner sidewall 712 from an upper side. At this time, the step 783 of the cover surface 767 presses against the top edge of the housing sidewall 711 from an upper side. When the cover 658 and the housing sidewall 711 are connected through the latches 659 and the latch slots 760, the cover 658 can be detachably connected to the housing 601 and the liner 702, so that the housing 601 and the liner 702 can be detachably connected by the cover 658.

In the prior art, a structure such as a seal is typically used on the cover to repeatedly seal the liner. When the seal needs to be cleaned, the seal must be removed from the cover and be reinstalled in the cover after cleaning is completed. This is difficult to operate and can cause the seal to be ineffective in sealing after reinstallation.

In the present application, the liner 702 has flexibility. When the end portion 769 of the cover 658 contacts and presses against the flange 723 on the liner sidewall 712, the flange 723 can also function as a sealing ring to hermetically seal between the cover 658 and the liner 702. In an example, the liner 702 is made of a flexible material having elasticity, such as a silicon rubber. Thus, the cover 658 is capable of sealing with the liner 702, to prevent the content stored in the liner 702 from leaking out through the gap between the cover 658 and the liner 702. Further, since the top edge of the liner sidewall 712 is located below the tope edge of the housing sidewall 711, the liner 702 can be entirely placed inside the housing chamber 710. The liner 702 of a flexible material can also ensure that the liner 702 and the housing 601 are sealed against each other.

When the liner 702 of a flexible material is taken out from the housing 601, the liner 702 can be turned inside out to expose the inner surface of the liner 702, so as to thoroughly clean the liner 702.

Figure 9A:
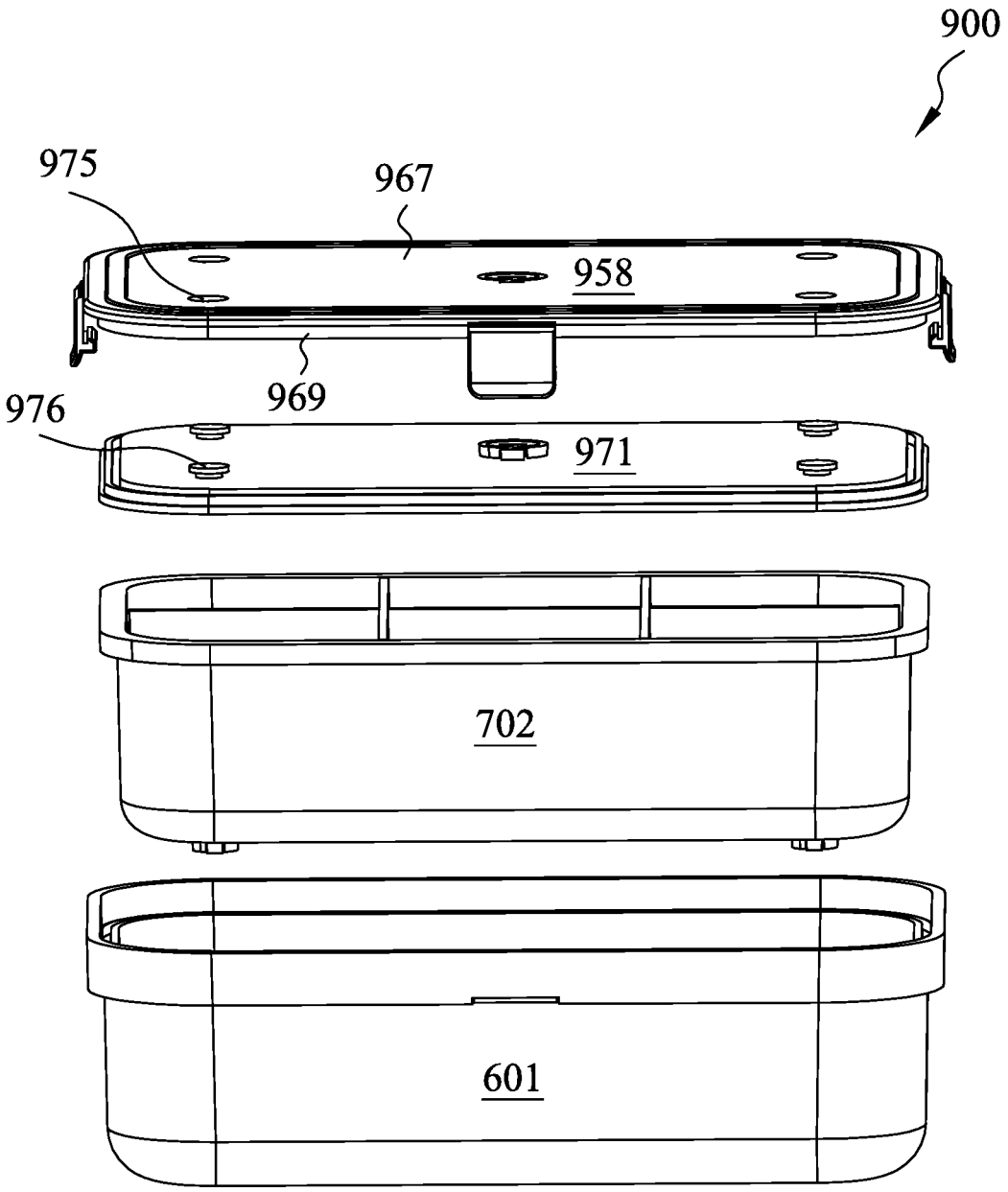
FIG. 9A is an exploded perspective view of a container 900 according to another embodiment of the present application.
Figure 9B:
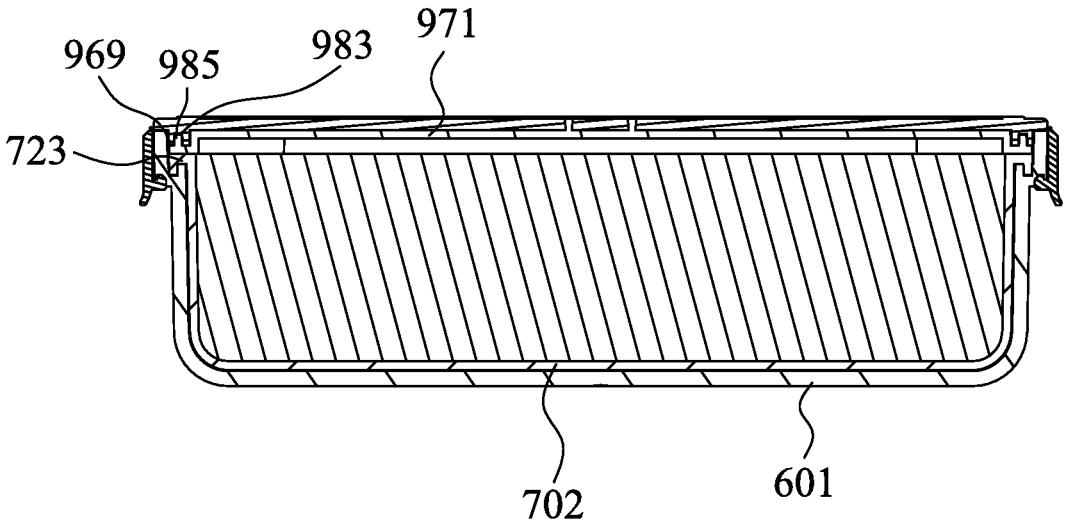
FIG. 9B is an axial cross-sectional view of the container 900 shown in FIG. 9A.

FIG. 9A and FIG. 9B illustrate a container 900 according to another embodiment the present application, wherein FIG. 9A is an exploded perspective view of the container 900 and FIG. 9B is an axial cross-sectional view of the container 900. As FIGS. 9A and 9B show, the container 900 comprises a housing 601, the liner 702, and the cover 658, wherein the housing 601 and the liner 702 are the same as the housing 601 and the liner 702 of the container 600 shown in FIG. 6 to FIG. 8 and thus redundant description is omitted.

In contrast to the container 600, the container 900 further comprises a plate 971. The plate 971 is placed between the liner 702 and the cover 958. The top surface of the plate 971 is formed with a buckling portion 976. An edge of the plate 971 is formed with a circular flange 985 protruding upwardly.

The cover 958 comprises a cover surface 967 and an end portion 969. The cover surface 967 is formed with a through hole 975, which cooperates with the fastening portion 976 so that the pad 971 is connected below the cover surface 967. The end portion 969 is formed with a circular groove 983, which is recessed from the lower surface of the end portion 969. The groove 983 cooperates with the flange 985 of the plate 971, so that the flange 985 can be inserted into the groove 983. The backing plate 971 can thus be connected to the lower side of the cover 958.

The plate 971 is also made of a flexible material. In an example, the plate 971 is made of a silicone rubber. When the cover 958 is fastened on the housing 601, the plate 971 presses against the flange 723 of the liner sidewall 712, so that the cover 958 and the liner 702 can be better sealed.

Figure 10A:
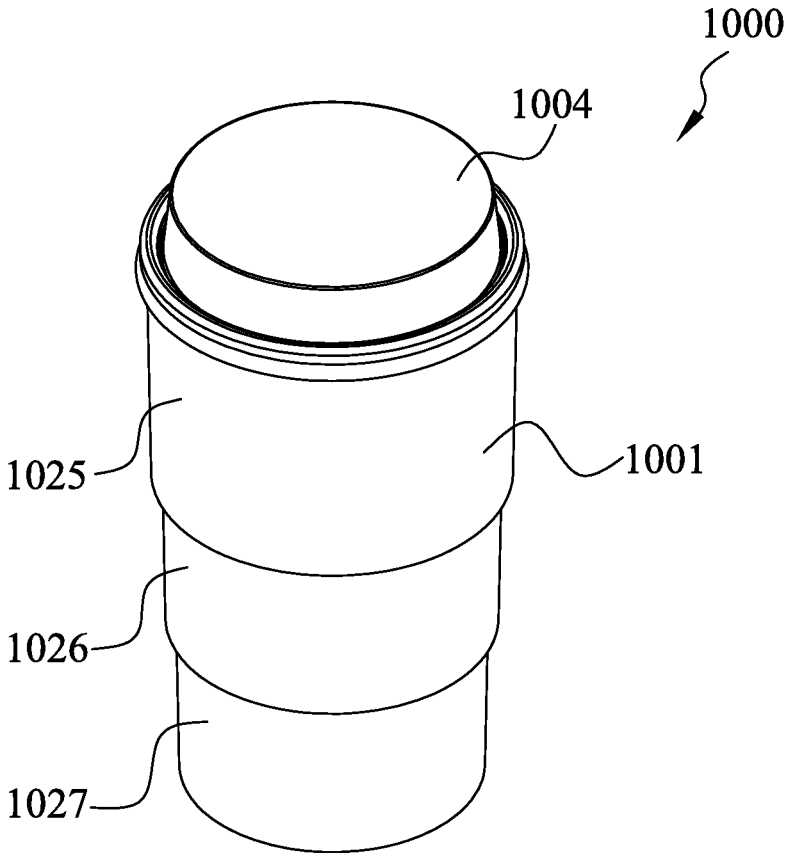
FIGS. 10A and 10B are perspective views of container 1000 according to another embodiment of the present application in different states.
Figure 10B:
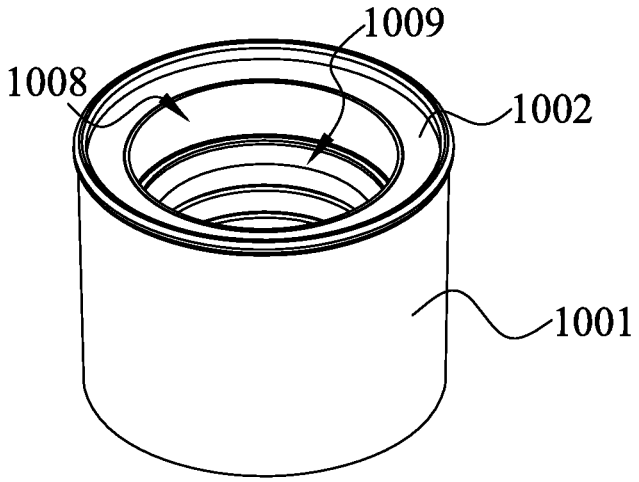

FIGS. 10A and 10B are perspective views of a container 1000 according to another embodiment of the present application, wherein FIG. 10A illustrates the overall configuration of the container 1000 in an expanded state and FIG. 10B shows the overall structure of the container 1000 in a folded state. In order to show the liner 1002 of the container 1000 more clearly, the cover 1004 shown in FIG. 10A is omitted in FIG. 10B.

Figure 12A:
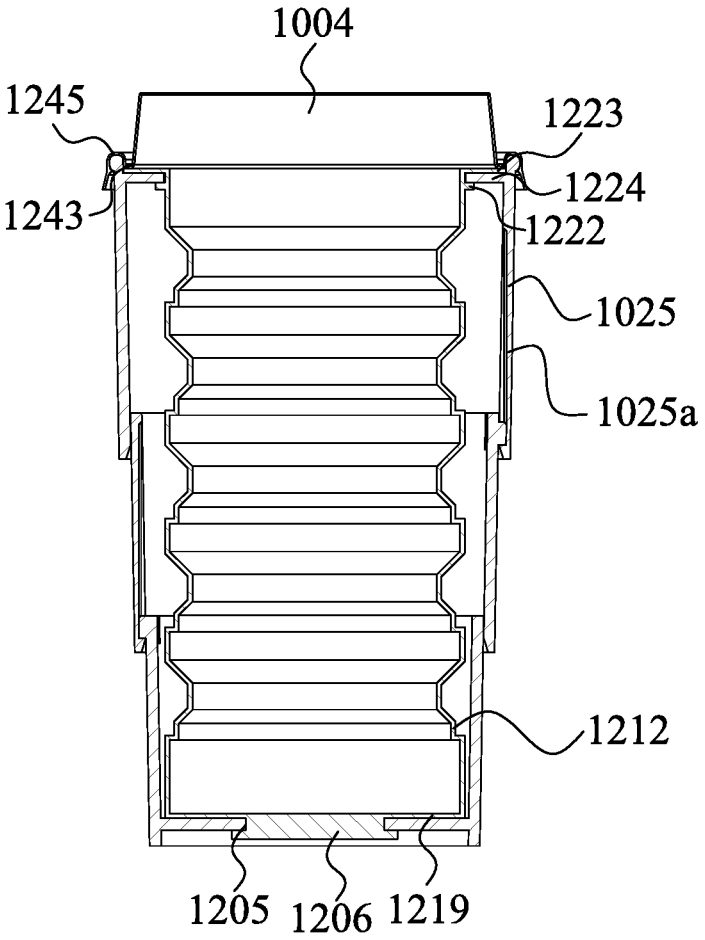
FIGS. 12A and 12B are axial cross-sectional views of the container 1000 shown in FIGS. 10A and 10B, respectively.

As FIGS. 10A and 10B show, the container 1000 is a cylindrical cup shape and comprises a housing 1001 and a liner 1002. The liner 1002 is accommodated inside the housing 1001. The liner 1002 has a liner chamber 1009 for receiving or accommodating contents (solid or liquid contents). The liner chamber 1009 has a liner top opening 1008 at the top of the liner chamber 1009. Contents stored or accommodated in the liner chamber 1009 can be taken out or poured out from the liner top opening 1008. The liner chamber 1009 is liquid proof. In this embodiment, liquid proof means that, even if the content in the liner chamber 1009 is liquid, the content will not leak out from any parts of the liner 1002 (the liner sidewall 1212, the liner bottom wall 1219, and their connection sites as shown in FIG. 12A) except for the liner top opening 1008, so that the liner 1002 can reliably receive or carry the contents.

The container 1000 further comprises a cover 1004. The cover 1004 is placed on top of the housing 1001 and the liner 1002, so that the cover 1004 can close the liner top opening 1008 of the container 1000.

The container 1000 can be in a folded state or in an extended state. When the container 1000 is folded or extended, the housing 1001 and the liner 1002 retract and extend (adjust) accordingly, to reduce or increase the height of the container 1000. The larger the height of the container 1000 is, the more contents the container can carry. The smaller the height of the container 1000 is, the more convenient the container can be carried. In some embodiments, only the housing can be extended and retracted, while the liner needs not be folded or extended.

More specifically, the housing 1001 comprises, from outside to inside and in the height direction, sequentially connected top telescopic section 1025, middle telescopic section 1026, and bottom telescopic section 1027. Their diameters gradually decrease, so that adjacent telescopic sections can telescopically connected, to expand the housing 1001 to increase the height of the housing 1001 or to contract the housing to reduce the height of the housing 1001. The top of the top telescopic section 1025 is the top of the housing 1001. The bottom of the bottom telescopic section 1027 is the bottom of the housing 1001. When the housing 1001 is extended or retracted, the liner 1002 can be expanded or folded together with the housing 1001, to reduce or increase the height of the liner 1002 accordingly. In the expanded state of the container 1000 shown in FIG. 10A, the bottom telescopic section 1027 extends out of the middle telescopic section 1026 and the middle telescopic section 1026 extends out of the top telescopic section 1025, so that the container 1000 has the maximum height. When the container 1000 is in the folded state shown in FIG. 10B, the bottom telescopic section 1027 is retracted into the middle telescopic section 1026, and the middle telescopic section 1026 is retracted into the top telescopic section 1025, so that the container 1000 has the minimum height.

In an example, the housing 1001 is made of a rigid material, such as plastics, so that the housing 1001 can provide a better support. It should be noted that, depending on the needed liner length and liner volume requirements, the housing 1001 can also be formed by telescopic sections of different numbers.

Figure 11:
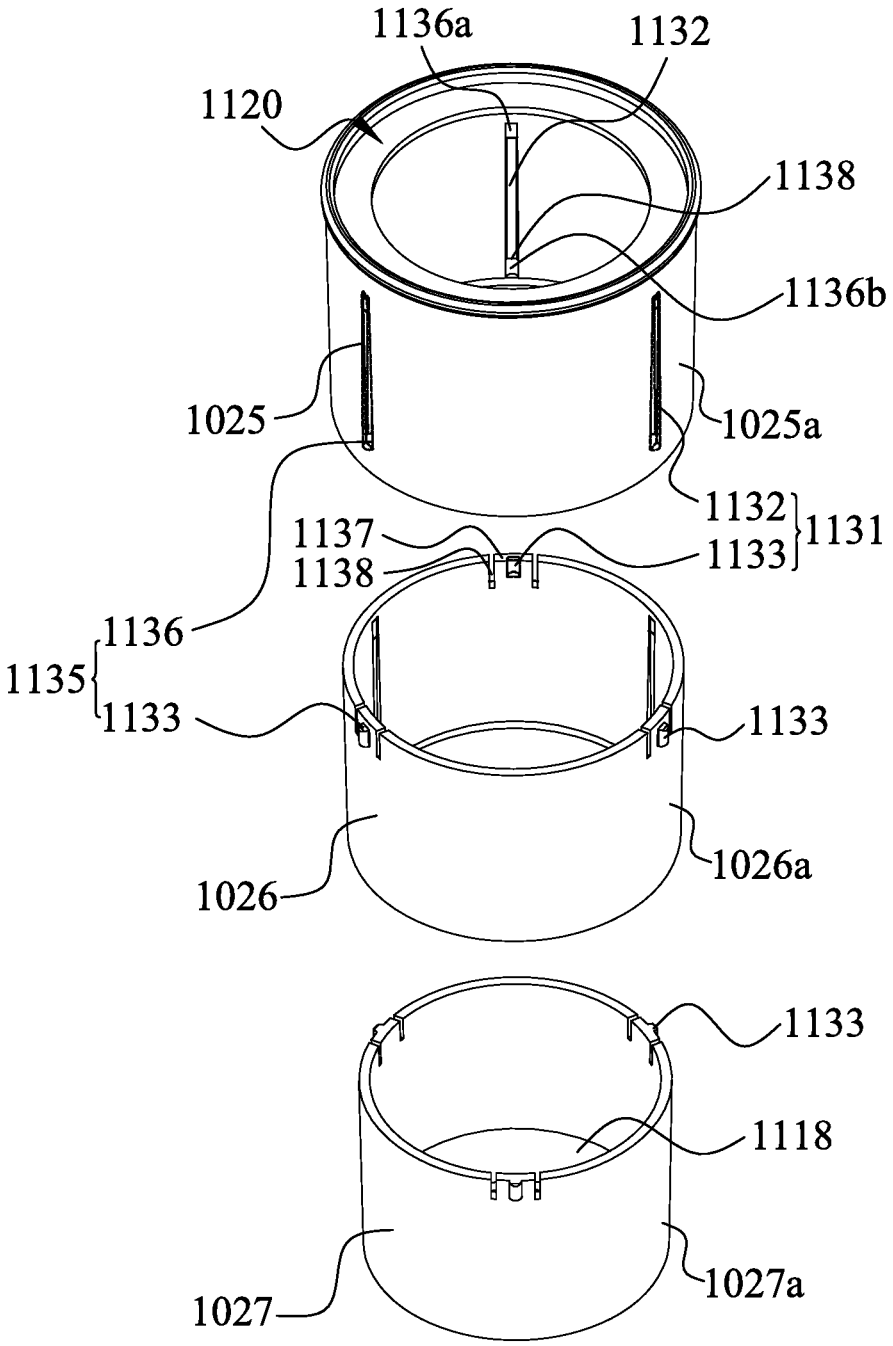
FIG. 11 is an exploded perspective view of a housing 1001 shown in FIG. 10A.

FIG. 11 is an exploded perspective view of the housing 1001 shown in FIG. 10A for illustrating the specific structure of the housing 1001 and the connection structure of the three telescopic sections.

As is shown in FIG. 11, the housing 1001 has a housing top opening 1120 formed at the top of the housing and a housing bottom wall 1118 formed at the bottom of the housing. Of course, in some embodiments, the housing 1001 can be formed without a housing bottom wall 1118. The top telescopic section 1025 of the housing 1001 has a telescopic sidewall 1025*a*; the middle telescopic section 1026 has a telescopic sidewall 1026*a*; and the bottom telescopic section 1027 has a telescopic sidewall 1027*a*. The top edge portion of the telescopic sidewall 1025*a* forms the housing top opening 1120. The bottom edge portion of the telescopic sidewall 1027*a* is joined with the housing bottom wall 1118 of the housing 1001. In addition, adjacent telescopic sidewalls 1025*a*, 1026*a*, and 1027*a* are movably connected, so that the adjacent telescopic sections can move relatively to each other to expand or retract the housing 1001.

A sliding mechanism 1131 and a locking device 1135 are formed on the telescopic sidewall of each telescopic section. The sliding mechanism 1131 is used to guide adjacent telescopic sections to move relatively to each other. The locking device 1135 is used to lock or release adjacent telescopic sections. When the locking device 1135 releases adjacent telescopic sections, they can move relatively to the position shown in FIG. 10A or 10B. When the locking device 1135 locks adjacent telescopic sections, they cannot move relatively to each other and are maintained in the position as shown in FIG. 10A or 10B.

The structure of the sliding mechanism 1131 will be described below using the top telescopic section 1025 and the middle telescopic section 1026 as examples. In the embodiment shown in FIG. 11, the sliding mechanism 1131 comprises a guide groove 1132 and a slider 1133. The guide groove 1132 is formed on the inner surface of the telescopic sidewall 1025*a* of the top telescopic section 1025. The guide groove 1132 is recessed inwardly in the thickness direction (i.e., radial direction) of the housing 1001, and extends longitudinally along the height direction (i.e., axial direction) of the housing 1001. The slider 1133 is formed on the outer surface of the telescopic sidewall 1026*a* of the middle telescopic section 1026 and in a corresponding position to engage the guide groove 1132. The slider 1133 extends from the outer surface of the telescopic sidewall 1026*a* and protrudes outwardly in the thickness direction (i.e., axial direction) of the housing 1001. The slider 1133 is inserted in the guide groove 1132 and slides along the extending direction of the guide groove 1132 (i.e., the height direction of the housing 1001), so that the middle telescopic section 1026 can move relatively to the top telescopic section 1025 to retract into the top telescopic section 1025 or extend out from the top telescopic section 1025.

In an example, three guide grooves 1132 are formed on the inner surface of the telescopic sidewall 1025*a* of the top telescopic section 1025 (two of the guide grooves 1132 are blocked by the telescopic sidewall 1025*a* and are shown in dotted lines). The guide grooves 1132 have the same shape and evenly distributed in the circumferential direction of the housing 1001. Correspondingly, three sliders 1133 are also formed on the outer surface of the telescopic sidewall 1026*a* of the middle telescopic section 1026 (one of the sliders 1133 is blocked by the telescopic sidewall 1026*a* and is shown in dotted lines). The sliders 1133 have the same shape.

In this embodiment, three sliding mechanisms 1131 are provided to make sliding between the middle telescopic section 1026 and the top telescopic section 1025 more smooth. In some embodiments, it is also possible to provide more or fewer sliding mechanisms. Further, in the present embodiment, the guide grooves 1132 are formed on the inner surface of the sidewall telescopic section 1025*a*. The sliders 1133 are formed on the outer surface of the telescopic sidewall 1026*a*. In some embodiments, the guide grooves 1132 can also be formed on the outer surface of the telescopic sidewall 1026*a*, while the sliders 1133 are formed on the inner surface of the telescopic sidewall 1025*a*.

Similarly, the inner surface of the telescopic sidewall 1026*a* of the middle telescopic section 1026 and the outer surface of the telescopic sidewall 1027*a* of the bottom telescopic section 1027 are respectively formed with matching guide groove 1132 and slider 1133 to form a sliding mechanism 1131. The slider 1133 in each sliding mechanism 1131 is inserted in the corresponding guide groove 1132 and relatively slides along the extending direction (i.e., the height direction) of the guide groove 1132, so that the bottom telescopic section 1027 can move relatively to the middle telescopic section 1026 to retract into the middle telescopic section 1026 or extend out from the middle telescopic section 1026.

Those skilled in the art will appreciate that the slide mechanism can also be any other means for guiding slides known to those skilled in the art, such as slide rail mechanism or ball rail mechanism, and the like. In some embodiments, when the moving direction of each telescopic section is restricted, the sliding mechanism can even be omitted.

In the embodiment illustrated in FIG. 11, the locking device 1135 comprises a lock portion and a lock receiving portion. The lock portion is the slider 1133. The lock receiving portion is a locking groove 1136. The slider 1133 is formed on a cantilever 1137. The slider 1133 matches the size of the locking groove 1136. More specifically, the locking groove 1136 comprises a top locking groove 1136*a* and a bottom locking groove 1136*b*, which are formed respectively at the top and the bottom of the guide groove 1132 (in its extending direction) in the telescopic sidewall 1025*a* of the top telescopic section 1025. Comparing with the guide groove 1132, the top locking groove 1136*a* and the bottom locking groove 1136*b* have a larger groove depth (i.e., the depth of the locking groove 1136 in the radial direction is greater than the depth of the guide groove 1132). Two through slots 1138 are formed on both sides of the slider 1133 on the telescopic sidewall 1026*a* of the middle telescopic section 1026 and arranged in the circumferential direction to form the cantilever 1137 between the two through slots 1138. In this embodiment, the housing 1001 is a material with a certain elasticity, such as plastic, so that the cantilever 1137 can have a certain elasticity. When the cantilever 1137 elastically moves, the slider 1133 moves in a radial direction.

When the slider 1133 is accommodated in the top locking groove 1136*a* (i.e., the position shown in FIG. 10B), the slider 1133 is accommodated in the top locking groove 1136*a* and locked by the top locking groove 1136*a*, and thus is unable to continue to move in the height direction. When the operator applies a certain amount of external force to forcibly pull the slider 1133 to move, the cantilever 1137 can elastically deform, causing the slider 1133 to move radially inwardly to exit the top locking groove 1136*a* and re-enter the guide groove 1132. As the guide groove 1132 has a smaller groove depth, the cantilever 1137 continues to maintain a deformed state, until the slider 1133 re-enters the bottom locking groove 1136*b*, where the cantilever 1137 restores elasticity to lock the slider 1133 in the bottom locking groove 1136*b*.

In this embodiment, the locking device and the sliding mechanism both use the slider 1133. The top locking groove 1136*a* and the bottom locking groove 1136*b* are respectively formed at the two ends of the guide groove 1132 to simplify the structures of the locking device and the sliding mechanism. In some embodiments, the locking device and the sliding mechanism need not use the same slider and the locking groove needs not be formed in the guide groove 1132, as long as the slider and the locking groove can form a matching locking device.

By providing a sliding mechanism, the housing 1001 can be telescopically folded in a predetermined direction, thereby increasing or decreasing the height of the housing 1001. In addition, by providing a locking device, the housing 1001 can be fixed at a certain position during the telescopic folding transformation, where the housing 1001 can withstand certain external force without the telescopic folding transformation, making the container 1000 more reliable.

Figure 12B:
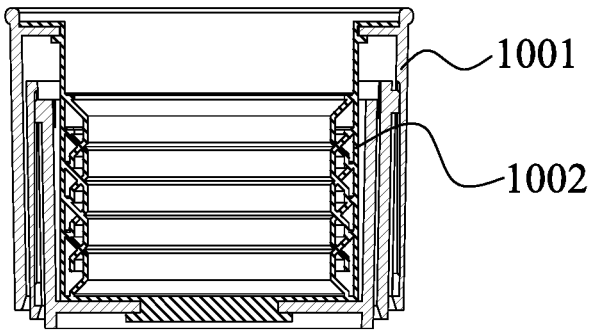

FIGS. 12A and 12B are axial cross-sectional views of the container 1000 shown in FIGS. 10A and 10B, respectively, for illustrating internal configurations of the container 1000 in different states, so as to explain detailed structures of the liner 1002, and the mating connection relationship among the liner 1002, the housing 1001, and the cover 1004.

As FIGS. 12A and 12B show, the liner 1002 comprises a liner sidewall 1212 and a liner bottom wall 1219 surrounding the liner chamber 1009. The liner bottom wall 1219 is connected to the bottom edge portion of the liner sidewall 1212. In some embodiments, the liner 1002 can be formed without the liner bottom wall 1219. In some embodiments, the liner 1002 can be retractable (adjustable), so that the height of the liner can be adjusted when the housing 1001 telescopically changes. In some embodiments, the liner 1002 can be made of a flexible material, such as a silica gel material, to be stretchable, to enable the liner sidewall 1212 to stretch and contract and to ensure the liner 1002 liquid proof. In some embodiments, the liner 1002 has a folding member to enable the liner 1002 to expand and contract through folding. For example, the liner sidewall 1212 has a pleated shape, so that the liner sidewall 1212 can be folded when the housing 1001 expands and contracts.

In the present application, the liner stretching can also be achieved in other manners, so long as the height of the liner sidewall 1212 can be adjusted when the housing 1001 expands and contracts while ensuring that the liner 1002 is liquid proof. In some embodiments where an easy-to-carry housing is needed, the liner needs not to expand and contract along with the housing expansion and contraction, as long as the housing can expand and contract.

The liner sidewall 1212 at its top edge portion is formed with two flanges, i.e., an upper flange 1223 and lower flange 1222, axially spaced apart. Each flange extends circumferentially. In an example, the upper flange 1223 and the lower flange 1222 are formed by the top edge of the liner sidewall 1212 protruding radially outwardly. The bottom surface of the liner sidewall 1219 is formed with a buckling portion 1206 protruding outwardly.

The telescopic sidewall 1025*a* of the top telescopic section 1025 is formed with a circle of mounting boss 1224 extending in a circumferential direction. In an example, the mounting boss 1224 is formed by the telescopic sidewalls 1025*a* protruding inwardly. The mounting boss 1224 has a thickness that is the same as the distance between the flanges 1223, 1222. The housing bottom wall 1118 is formed with a through hole 1205 passing through the housing bottom wall 1118. The shape and size of the through hole 1205 match with the fastening portion 1206 on the liner bottom wall 1219.

When the mounting boss 1224 on the top telescopic section 1025 is inserted between the upper flange 1223 and the lower flange 1222 of the liner sidewall 1212, the upper flange 1223 and the lower flange 1222 abut against the mounting boss 1224 from upper and lower sides, thereby detachably connecting the top edge of the liner sidewall 1212 to the telescopic sidewall 1025*a* of the top telescopic section 1025. In addition, the fastening portion 1206 on the liner bottom wall 1219 can be inserted into the through hole 1205 in the housing bottom wall 1118, so that the liner bottom wall 1219 is supported on and connected to the housing bottom wall 1118. As a result, the liner 1002 is detachably connected to the housing 1001 from both the top and the bottom sides. By detachably connecting the liner and the housing, the user can combine and use different housings and liners.

When the housing 1001 expands and retracts, the liner sidewall 1212 can be easily expanded or folded as the housing 1001 expands and retracts, as the top and the bottom sides of the liner 1002 are connected to the top and the bottom of the housing 1001. In addition, since the liner 1002 and the housing 1001 are detachably connected, the container 1000 also has the advantage of having different combinations of housings 1001 and liners 1002, as described in the foregoing embodiments.

As is shown in FIG. 12A, the liner sidewall 1212 and the top telescopic sidewall 1025*a* have a space therebetween. The space can accommodate the telescopic sidewalls 1026*a* and 1027*a* in the folded state (see FIG. 12B). In an example, a heating device or a sensing device (e.g., a weight sensing device) or the like can be accommodated in such space to heat or sense the contents contained in the liner.

The cover 1004 is placed above the liner chamber 1009. The edge of the cover 1004 forms an "N"-shaped bent portion. The outer edge of the cover 1004 has a receiving groove 1245 recessed upwardly. A downwardly recessed hook portion 1243 is formed on the inside of the receiving groove 1245. The receiving groove 1245 receives the top edge of the telescopic section 1025, while the hook portion 1243 presses against the upper flange 1223 of the liner 1002. The cover 1004 thus releasably attaches to the housing 1001 and the liner 1002 and close the liner top opening 1008.

Of course, it is noted that the liner 1002 and the housing 1001 can be detachably connected in other manners, such as the connection shown in the embodiments of FIG. 1 to FIG. 3. And in some embodiments, the liner 1002 and the housing 1001 can be non-detachably fixedly connected, so long as the liner 1002 and the housing 1001 can to expand or collapse together.

When the container 1000 changes from an expanded state shown in FIG. 12A to a folded state shown in FIG. 12B, the various telescopic sections of the housing 1001 slide relative to each other via sliding mechanism 1131, so that the telescopic sections are retracted in turn. In the position shown in FIG. 12B, the locking device 1135 locks the various telescopic sections at their relative positions, so that the height of the housing 1001 is reduced to its minimum height. The top and the bottom of the liner 1002 are connected to the top and the bottom of the housing 1001, respectively, so that the liner 1002 and the outer housing 1001 expand and contract together, to adjust the height of the liner 1002.

When the container 1000 is unfolded from the folded state shown in FIG. 12B to the expanded state shown in FIG. 12A, the various telescopic sections of the housing 1001 slide relatively to one another via the sliding mechanism 1131, so that the telescopic sections are sequentially expanded. In the position shown in FIG. 12A, the locking device 1135 locks the various telescopic sections at their relative position, so that the height of the housing 1001 is at its maximum height. The top and the bottom of the liner 1002 are connected to the top and the bottom of the housing 1001, so that the liner 1002 and the housing 1001 expand together to increase the height of the liner 1002.

Figure 13A:
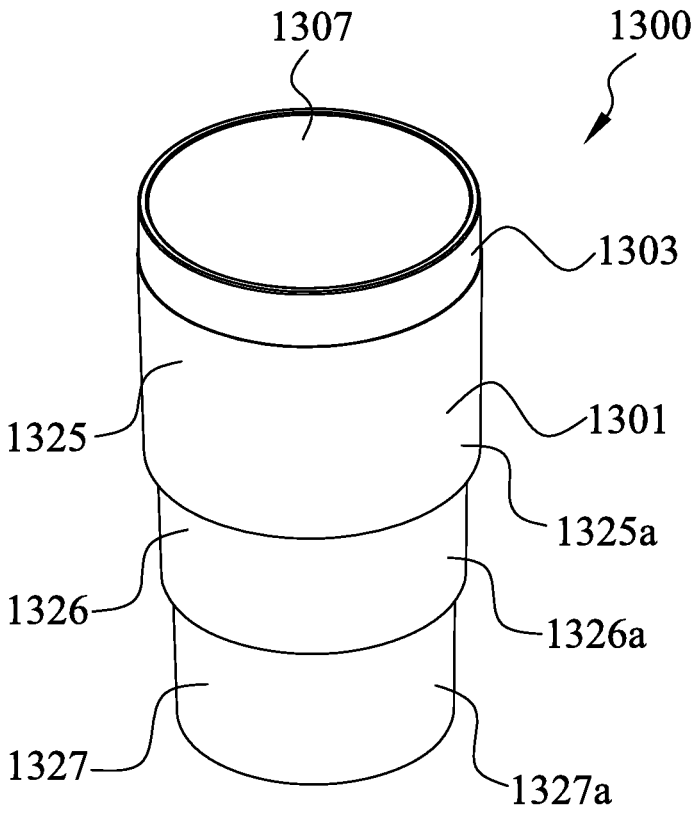
FIGS. 13A and 13B are perspective views of a container 1300 according to a further embodiment of the present application in different states.
Figure 13B:
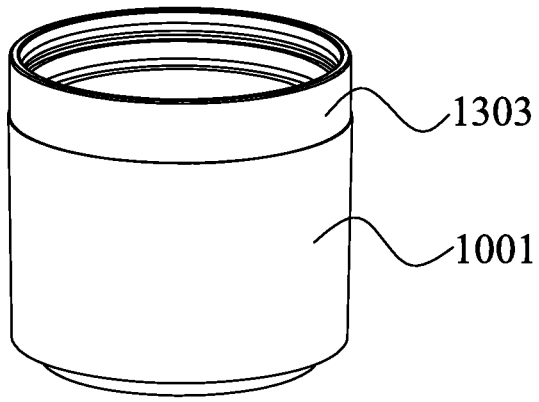

FIGS. 13A and 13B are perspective views of a container 1300 according to a further embodiment of the present application, wherein FIG. 13A illustrates the overall configuration of the container 1300 in an expanded state, and FIG. 13B shows the overall structure of the container 1300 in the folded state. In order to more clearly show the cover 1303 of the container 1300, the upper lid 1307 shown in FIG. 13A is omitted from FIG. 13B.

As FIGS. 13A and 13B show, the container 1300 also comprises a housing 1301 and a liner (not shown in the drawings). The container 1300 can be in the expanded state as shown in FIG. 13A or in the folded state as shown in FIG. 13B. When the container 1300 is expanded or folded, the housing 1301 and the liner expand and contract accordingly to increase or reduce the height of the container 1300.

The housing 1301 comprises, from outside to inside and in the height direction, sequentially connected a top telescopic section 1325, a middle telescopic section 1326, and a bottom telescopic section 1327, whose diameters gradually decrease, so that adjacent telescopic sections are telescopically nested and connected. The housing 1301 can be extended to increase the height of the housing 1301 or shortened to reduce the height of the housing 1301. The telescopic sections comprise respective telescopic sidewalls 1325*a*, 1326*a*, and 1327*a*.

The container 1300 further comprises a cover 1303 and an upper lid 1307. The cover 1303 is for detachably coupling the housing 1301 and the liner. The upper lid 1307 can detachably cover on top of the cover 1303. The structure of the cover 1303 is the same as the structure of the cover 103 shown in FIGS. 1 to 3 and redundant description is omitted. The upper lid 1307 can be a cup cover, a pacifier, a coffee pot mouth, or the like.

Figure 14A:
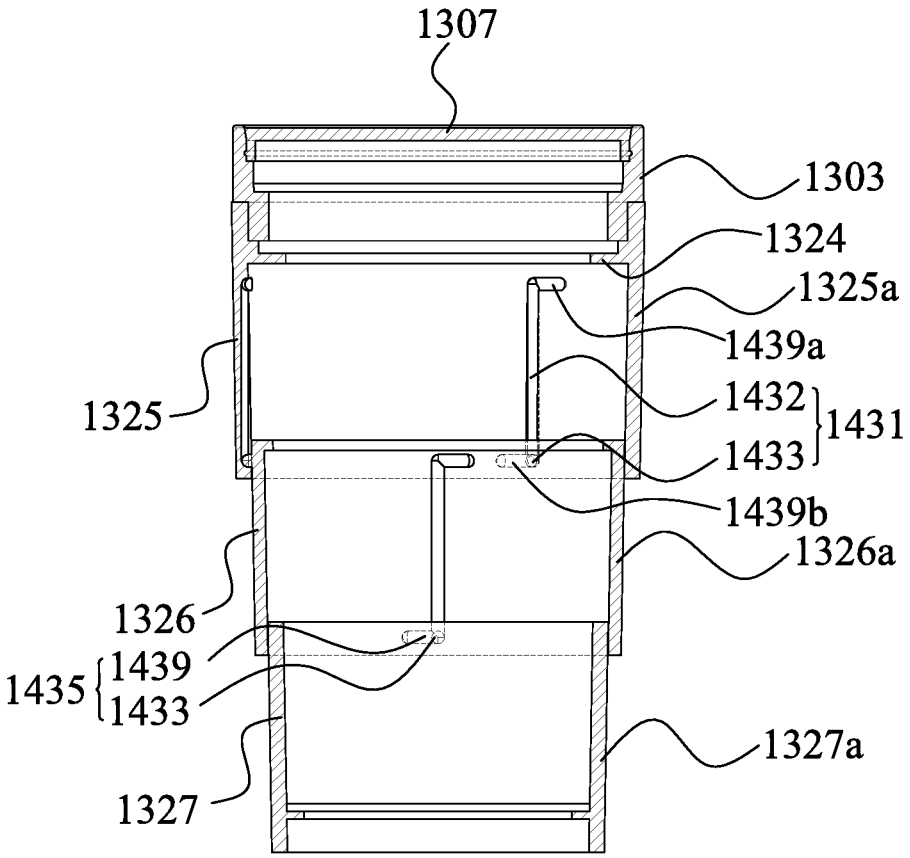
FIGS. 14A and 14B are axial cross-sectional views of the container 1300 shown in FIGS. 13A and 13B, respectively.
Figure 14B:
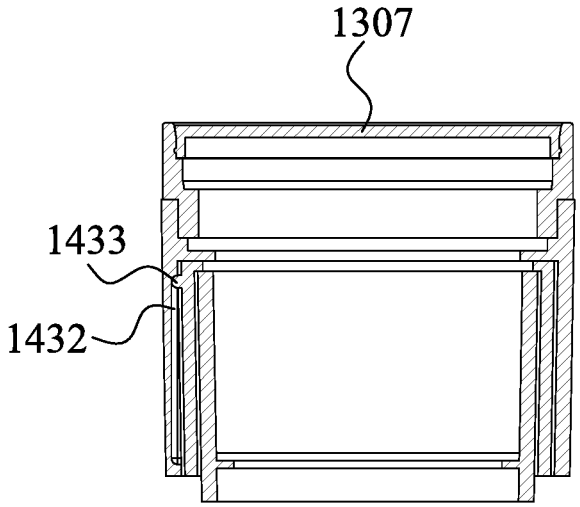

FIGS. 14A and 14B are axial cross-sectional views of the container 1300 shown in FIGS. 13A and 13B, respectively, for illustrating the internal configurations of the container 1300 in different states to explain the connection between the three telescopic sections of the housing 1301. In order to more clearly show the sliding mechanism and the locking device on the telescopic sections, the liner is omitted in FIGS. 14A and 14B. Those skilled in the art can appreciate that the structure of the liner in this embodiment is substantially the same as that shown FIGS. 12A and 12B, except that the top edge of the liner sidewall comprises only an upper flange but not a lower flange. This is because, in the present embodiment, the housing 1301 and the liner are connected through the cover 1303. The housing 1301 also comprises a mounting boss 1424 formed on the top telescopic sidewall 1325*a*. The cover 1303 and the mounting boss 1424 on the housing 1301 abut against the upper flange of the liner from both sides, thereby detachably connecting the housing 1301, the liner, and the cover 1303.

As FIGS. 14A and 14B show, a sliding mechanism 1431 and a locking device 1435 are also formed on the telescopic sidewalls of the telescopic sections of the housing 1301. The sliding mechanism 1431 is used to guide the relative movement of adjacent telescopic sections. The locking device 1435 is used for locking or releasing adjacent telescopic sections.

The sliding mechanism 1431 comprises guide grooves 1432 formed on an inner surface of the top telescopic sidewall 1325*a* and on an inner surface of the middle telescopic sidewall 1326*a*, as well as a slider 1433 formed on outer surface of the middle telescopic 1326*a* and on outer surface of the bottom telescopic sidewall 1327*a*. Such guide grooves 1432 and slides 1433 cooperate with one another, to allow the top telescopic section 1325, the middle telescopic section 1326, and the bottom telescopic section 1327 to slide relatively to one another along the extension direction of the guide groove 1432.

Different from the housing 1001 of the container 1000, the structure of the locking device 1435 is different from that of the locking device 1135 in this embodiment. The locking device 1435 comprises a slider 1433 and a locking groove 1439. The locking groove 1439 comprises a top locking groove 1439*a* and a bottom locking groove 1439*b*, which are respectively joined to the top and the bottom of the guide groove 1432 in its extending direction and extend away from the height direction of the housing 1301. As a more specific embodiment, the top locking groove 1439*a* and the bottom locking groove 1439*b* extend in opposite directions, respectively, so that the top locking groove 1439*a*, the guide groove 1432, and the bottom locking groove 1439*b* form a z-shaped slot.

When the operator rotates the telescopic sections of the housing 1301, the slider 1433 enters the locking groove 1439 from the top or the bottom of the guide groove 1432. The locking groove 1439 locks the locking slide 1433, so that the slide 1433 cannot continue to slide relative to the guide groove 1432 in the height direction. When the operator rotates the telescopic sections of the housing 1301 in an opposite direction, to move the slider 1433 out of the locking groove 1439 and into the top or the bottom of the guide groove 1432, the locking groove 1439 releases the slider 1433, so that the slide 1433 can continue to slide relative to the guide groove 1432 in the height direction. As described above, when the slider 1433 slides in the height direction relative to the guide groove 1432, the housing 1301 can be folded or unfolded to reach a state shown in FIG. 14A or 14B.

At this time, although it is not shown in the drawings, those skilled in the art would appreciate that the liner sidewall will be folded or extended as the housing 1301 is folded or unfolded.

The container 1000 and the container 1300 show the structures of two different locking devices. Those skilled in the art would appreciate that the locking device can also be other devices for limiting relative movement known to those skilled in the art.

Figure 15A:
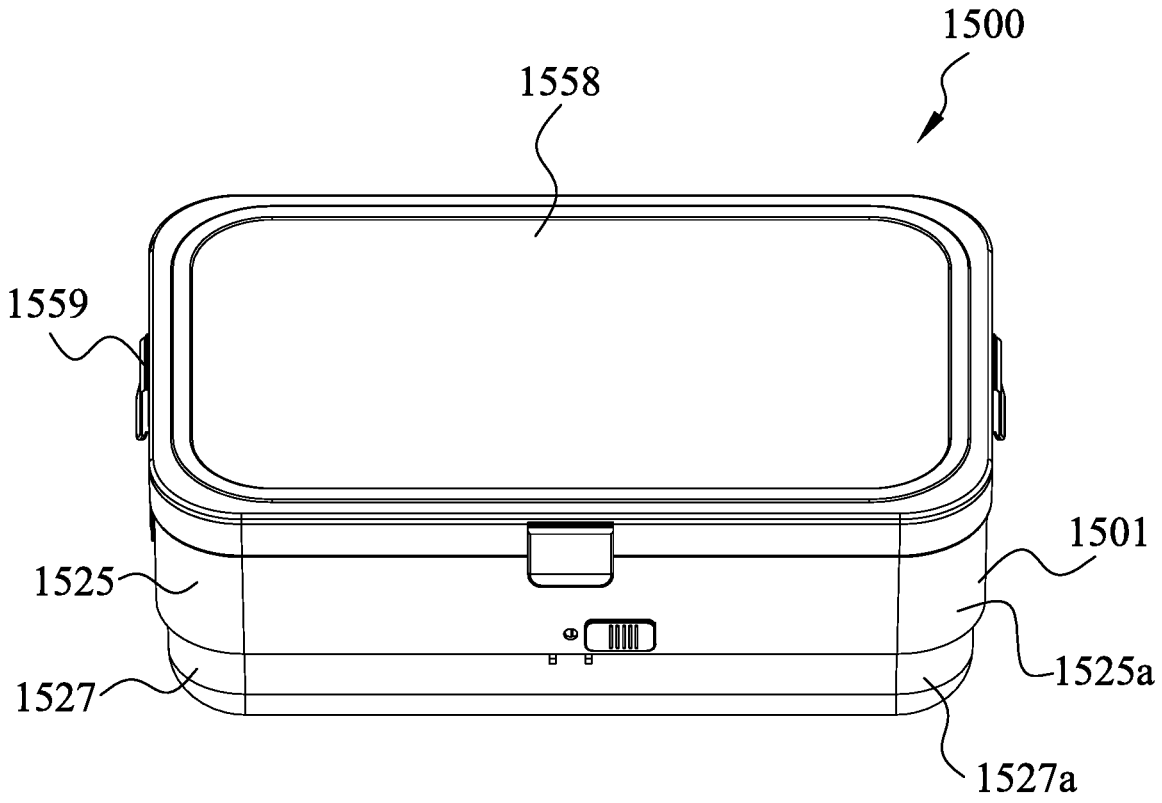
FIGS. 15A and 15B are perspective views of a container 1500 according to a still further embodiment of the present application in different states.
Figure 15B:
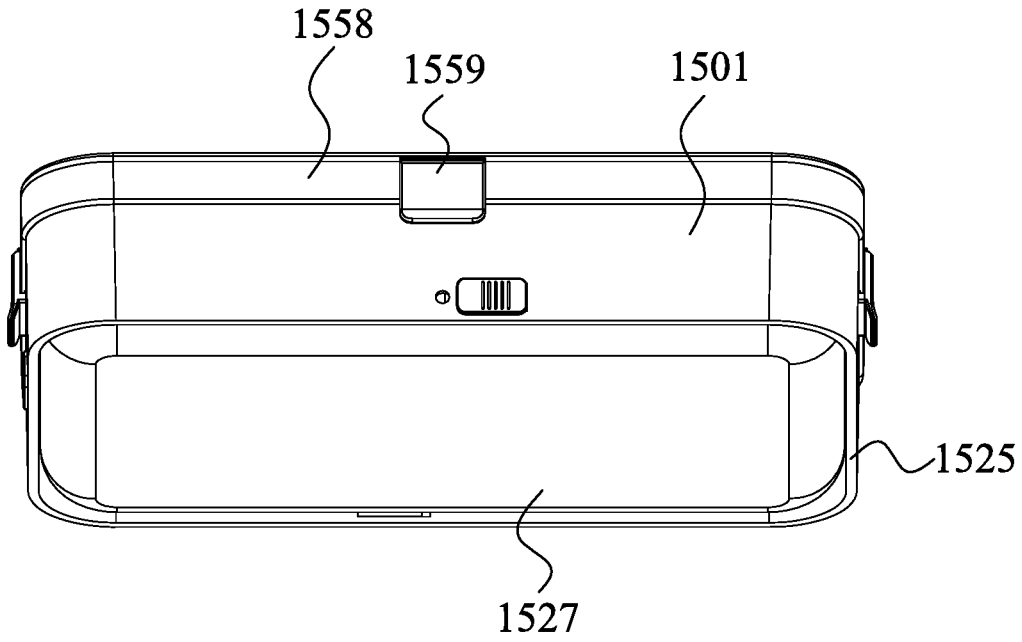

FIGS. 15A and 15B are perspective views of a container 1500 according to a still further embodiment of the present application, in which FIG. 15A shows the overall structure of the container 1500 in a deployed state from a top down perspective, and FIG. 15B shows the overall structure of the container 1500 in a folded state from a bottom-up perspective.

As FIGS. 15A and 15B show, the container 1500 has a rectangular box shape. The container 1500 comprises a housing 1501 and a cover 1558. On one side of the cover 1558, a plurality of latches 1559 are formed, through which the cover 1558 can be detachably fastened onto the housing 1501. The specific structures of the cover 1558, the liner (not shown in the drawings), and the latches 1559 of the container 1500 are the same as those of the container 600 shown in FIGS. 6 to 8 and redundant description is omitted.

Differing from the container 600, the container 1500 can be in an expanded state as shown in FIG. 15A or in a folded state as shown in FIG. 15B. When the container 1500 is expanded or folded, the housing 1501 and the liner expands and retracts accordingly to increase or reduce the height of the container 1500.

The housing 1501 of the container 1500 comprises, from the outside to the inside, a top telescopic section 1525 and a bottom telescopic section 1527 which are connected in a height direction. The diameters of the top and bottom telescopic sections 1525, 1527 are sequentially reduced, so that the bottom telescopic section 1527 can be telescopically nested and connected to the top telescopic section 1525, to enable the housing 1501 to extend to increase the height of the housing 1501 or to collapse to reduce the height of the housing 1501. The top telescopic section 1525 has a top telescopic sidewall 1525*a*. The bottom telescopic section 1527 has a bottom telescopic sidewall 1527*a*.

Figure 16:
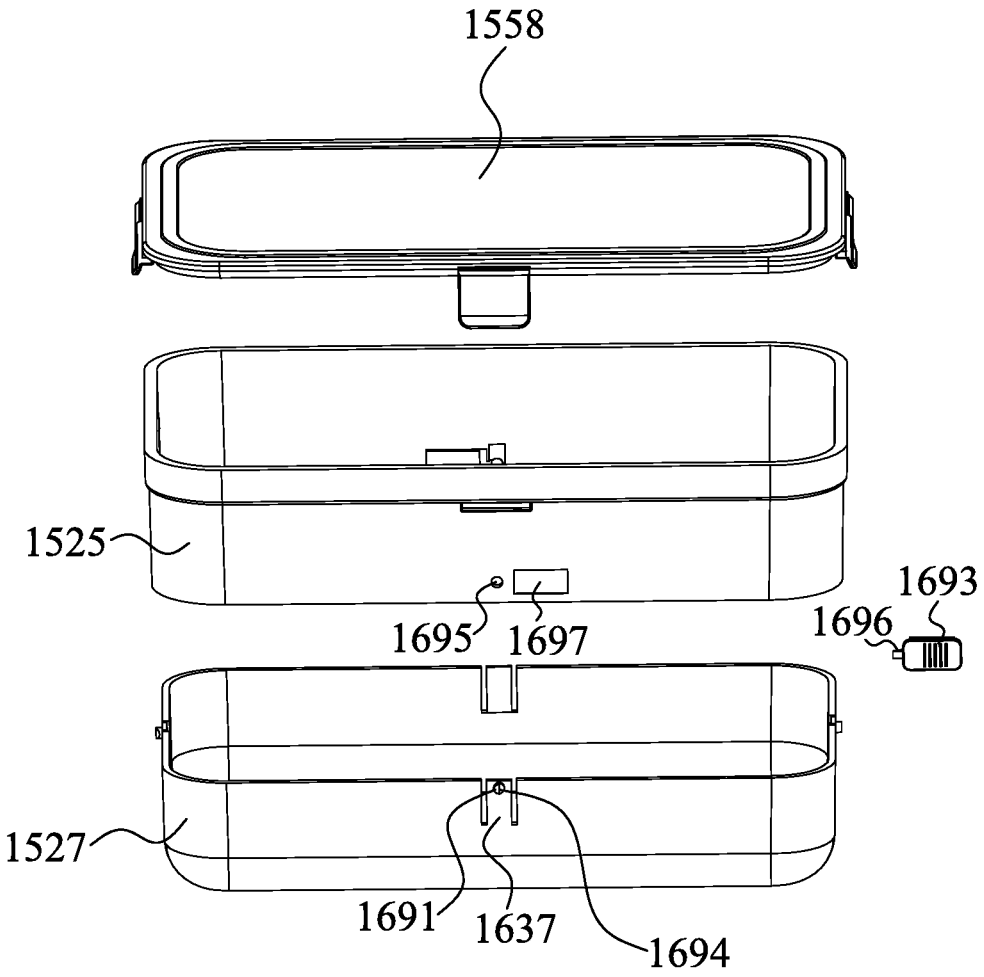
FIG. 16 is an exploded perspective view of the container 1500 shown in FIG. 15A.

FIG. 16 is an exploded perspective view of the container 1500 shown in FIG. 15A for illustrating the connection structure of the two telescopic sections. The liner is omitted from FIG. 16.

As is shown in FIG. 16, on each side of every telescopic sidewall of the housing 1501 of the rectangular box-shaped container 1500, a corresponding locking device 1635 is formed, but no sliding mechanism is provided. The locking device 1635 is used to lock or release the adjacent telescopic sections. The following description uses the locking device 1635 on the front side of the housing 1501 as an example. The locking devices 1635 on the other three sides have the same structure.

More specifically, the locking device 1635 comprises matching locking portion and a locking receiving portion, wherein the locking portion is a projection 1691. The projection 1691 is formed on the cantilever 1637. The locking receiving portion is a locking hole 1695. The projection 1691 is formed on the outer surface of the bottom telescopic sidewall 1527*a*. The locking hole 1695 passes through the top telescopic sidewall 1525*a* at a corresponding position. The projection 1691 can be inserted into the locking hole 1695 or exit from the locking hole 1695.

The locking device 1635 further comprises a locking pin 1693. The locking pin 1693 is mounted on the top telescopic sidewall 1525*a* next to the mounting hole 1697, to drive the movement of the projection 1691. As a more specific example, the locking pin 1693 can slide left and right in the mounting hole 1697. The end of the locking pin 1693 and the side of the projection 1691 have a pair of complementary inclined surfaces 1694 and 1696.

When the projection 1691 is inserted into the locking hole 1695, the projection 1691 is locked by the lock hole 1695 and cannot move in the height direction. When the locking pin 1693 slides to the left, the locking pin 1693 applies pressure to the projection 1691 through the complementary inclined surfaces. The cantilever 1637 is elastically deformed to cause the projection 1691 to contract inwardly to exit the locking hole 1695, so that the projection 1691 is released by the locked hole 1695. In this manner, the two telescopic sections can move relatively to each other.

In this embodiment, as the box-shaped container 1500 is rectangular and has a height within a certain range, the top telescopic section and the bottom telescopic section can only move relatively in the height direction, even if no sliding mechanism is provided. Accordingly, the sliding mechanism can be omitted.

Comparing with the container 1000 shown in FIG. 11, both the locking device 1135 and the locking device 1635 cause the slider (or the projection) to move radially through the elastic deformation of the cantilever. However, the locking portion (i.e., the projection 1691) of the locking device 1635 in this embodiment is locked in the locking hole 1695 passing through the sidewall. And a locking pin 1693 is also required to drive the projection 1691 to insert into or exit from the locking hole.

In some embodiments of the present application, the liner is made of a flexible material, to ensure that the liner is liquid proof while facilitating the folding of the liner. The housing is made of rigid material to provide better support for the container.

Because the liner is liquid proof, it is no longer necessary to for the structure of the housing to ensure the tightness of the container. Therefore, the housing can be formed in any retractable and foldable structures to achieve the purpose of changing the volume of the container, thereby making the container convenient to carry and more beautiful. In addition, in this application, the various telescopic sections of the housing can be locked by a locking device which is convenient to make and has a more reliable structure, to prevent contents carried inside the liner from spilling if the housing accidentally contracts when the container is expanded, or to prevent the housing from being accidentally deployed when the container is in the folded state.

In some embodiments of the present application, the flexible liner and the rigid housing are connected through a detachable structure, to facilitate the replacement and cleaning of the liner on the one hand and, on the other hand, to allow the user to combine and use different liners and housings depending on the needs, while ensuring liquid proof.

Although the present application has been described with reference to the specific embodiments shown in the accompanying drawings, it should be appreciated that, without departing from the spirit and the scope and the background taught by the present application, the containers in the embodiments of the present application can have many variations. Those skilled in the art will recognize that different ways can be used to change the exemplary structures in the embodiments disclosed in this application, all of which fall within the spirit of the application and the scope of the claims.

What is claimed is:

1. A container, comprising:

a housing defining a housing chamber, the housing forming a housing top opening at the top of the housing; and a liner removably received in the housing chamber, the liner being formed with a liner chamber and defining a liner top opening at a top of the liner;

wherein:

the liner is made of a flexible material and is liquid proof;

the housing comprises a housing bottom wall and a housing sidewall surrounding the housing chamber, the housing bottom wall being connected to a bottom of the housing sidewall, and the housing chamber forming the housing top opening at a top of the housing sidewall; and the liner has a liner bottom wall and a liner sidewall, the liner bottom wall being connected to a bottom of the liner sidewall, a top of the liner sidewall being detachably connected to the housing sidewall, so that the liner is detachably received in the housing chamber, and the top of the liner sidewall forming the liner top opening.

2. The container according to claim 1, wherein:

at least parts of the housing sidewall and the liner sidewall form a gap therebetween.

3. The container according to claim 1, wherein the flexible material comprises a silicone rubber.

4. A container, comprising:

a housing defining a housing chamber, the housing forming a housing top opening at the top of the housing; and a liner removably received in the housing chamber, the liner being formed with a liner chamber and defining a liner top opening at a top of the liner;

wherein the liner is made of a flexible material and is liquid proof, and wherein:

the housing comprises a mounting boss located between a top and a bottom of the housing, the mounting boss being formed by the housing protruding inwardly;

the liner comprises a flange, which is formed by outwardly protruding a top of the liner; and the flange of the liner abuts against the mounting boss of the housing, so that the top of the liner is detachably connected to the housing.

5. The container according to claim 4, wherein:

an engaging groove is formed on a top of the mounting boss, and the flange has a bent portion, which is capable of inserting into the engaging groove.

6. A container, comprising a housing defining a housing chamber, the housing forming a housing top opening at the top of the housing;

a liner removably received in the housing chamber, the liner being formed with a liner chamber and defining a liner top opening at a top of the liner;

wherein the liner is made of a flexible material and is liquid proof; and a cover detachably fastened to the housing;

wherein the container is so configured that, when the cover is fastened to the housing, the cover is in contact with a top of the liner to secure the liner inside the housing chamber.

7. The container according to claim 6, further comprises a partition plate connected to the liner, wherein the partition plate and the liner are integrally made of a flexible material.

8. The container according to claim 1, wherein the housing comprises a plurality of telescopic sections forming a telescopically nested connection.

9. The container according to claim 8, wherein the liner is retractable to adjust a height of the liner.

10. The container according to claim 9, wherein:

each of the telescopic sections has a telescopic sidewall, which is movably connected to a telescopic sidewall of an adjacent telescopic section; and the plurality of telescopic sections comprise a top telescopic section and a bottom telescopic section, a top of the telescopic sidewall of the top telescopic section forming the housing top opening.

11. The container according to claim 10, wherein:

the plurality of telescopic sections comprise a first telescopic section and a second telescopic section disposed adjacently to each other, the first telescopic section having a first telescopic sidewall, the second telescopic section having a second telescopic sidewall, the first telescopic section having a diameter larger than that of the second telescopic section;

the container further comprises a locking device, which has a locking portion and a lock receiving portion that cooperate with each other; the locking portion being formed on one of the first telescopic sidewall and the second telescopic sidewall; the lock receiving portion being formed at a corresponding position on the other of the first telescopic sidewall and the second telescopic sidewall; and the locking device being capable of locking or releasing the first telescopic section or the second telescopic section;

the locking device is so configured that:

when the locking device locks the first telescopic section or the second telescopic section, the first telescopic section and the second telescopic section cannot move relatively to each other; and when the locking device releases the first telescopic section or the second telescopic section, the first telescopic section and the second telescopic section can move relatively to each other, so that the second telescopic section can retract into or extend out from the first telescopic section.

12. The container according to claim 11, wherein:

the locking receiving portion is formed with a locking hole, the locking portion comprises a projection, which is capable of inserting into or exiting from the locking hole;

the locking portion and the locking receiving portion are so configured that the locking hole is capable of locking the projection when the projection inserts into the locking hole, and that the locking hole is capable of releasing the projection when the projection exits the locking hole; and the locking device further comprises a locking pin for driving the projection to insert into or exit from the locking hole.

13. The container according to claim 11, further comprises a sliding mechanism, wherein:

the sliding mechanism is formed at corresponding positions on the first telescopic sidewall and the second telescopic sidewall, and the sliding mechanism guides the first telescopic section and the second telescopic section to slide relatively to each other in a sliding direction.

14. The container according to claim 13, wherein:

the sliding mechanism is formed with a guide groove and a slider capable of sliding relatively to each other, the guide groove being formed on one of the first telescopic sidewall and the second telescopic sidewall, the slider being formed on the other of the first telescopic sidewall and the second telescopic sidewall;

the guide groove extends in the sliding direction; and the slider is movable relatively to the guide groove in the sliding direction.

15. The container according to claim 14, wherein:

the locking device is formed with a locking groove extending away from the sliding direction;

the slider is capable of entering into or exiting from the locking groove; and the locking groove is so configured that the locking groove can lock the slider when the slider enters into the locking groove, and that the locking groove can release the slider when the slider exits from the locking groove.

16. The container according to claim 15, wherein the locking groove defines a top locking groove and a bottom locking groove, the top locking groove being connected to a top of the guide groove, the bottom locking groove being connected to a bottom of the guide groove.

17. The container according to claim 14, wherein:

the locking device is formed with a card slot inside the guide groove;

the card slot has a size matching that of the slider to accommodate the slider; and the card slot is so configured that the card slot receives and locks the slider when the slider enters the card slot and that the card slot releases the slider when the slider exits the card slot.

18. The container according to claim 17, wherein the card slot comprises a top card slot and a bottom card slot, the top card slot being connected to a top of the guide groove, the bottom card slot being connected to a bottom of the guide groove.

19. The container according to claim 2, wherein the liner sidewall has a pleated shape, so that the liner sidewall is capable of folding when the housing retracts.

20. The container according to claim 2, further comprising at least one of a heating device and a sensing device positioned in the gap between the housing sidewall and the liner sidewall.

21. The container according to claim 1, wherein the liner bottom wall has an inner liner surface and an outer liner surface opposite the inner liner surface forming a bottom part of the liner chamber, wherein the housing bottom wall has an inner housing surface and an outer housing surface opposite the inner housing surface forming a bottom part of the housing chamber, wherein the inner housing surface is at least partially in contact with the outer liner surface.

* * * * *